US012241390B2

(12) United States Patent
Schock et al.

(10) Patent No.: US 12,241,390 B2
(45) Date of Patent: Mar. 4, 2025

(54) ACTUATION SYSTEM FOR AN INTERNAL COMBUSTION ENGINE

(71) Applicants: Board of Trustees of Michigan State University, East Lansing, MI (US); Mid Michigan Research, LLC, Brighton, MI (US)

(72) Inventors: Harold J. Schock, Brighton, MI (US); Thomas R. Stuecken, Eagle, MI (US); Jennifer Higel, Hayesville, NC (US); Gary Hunter, Dexter, MI (US)

(73) Assignees: Board of Trustees of Michigan State University, East Lansing, MI (US); Mid Michigan Research, LLC, Brighton, MI (US)

( * ) Notice: Subject to any disclaimer, the term of this patent is extended or adjusted under 35 U.S.C. 154(b) by 0 days.

(21) Appl. No.: 18/420,997

(22) Filed: Jan. 24, 2024

(65) Prior Publication Data

US 2024/0209759 A1 Jun. 27, 2024

Related U.S. Application Data

(63) Continuation of application No. PCT/US2022/038767, filed on Jul. 29, 2022.
(Continued)

(51) Int. Cl.
*F01L 13/00* (2006.01)
*F01L 1/02* (2006.01)
(Continued)

(52) U.S. Cl.
CPC ..... *F01L 13/0036* (2013.01); *F01L 1/022* (2013.01); *F01L 1/047* (2013.01); *F01L 1/34413* (2013.01);
(Continued)

(58) Field of Classification Search
CPC ..... F01L 13/0036; F01L 2013/0052; F01L 1/022; F01L 1/024; F01L 1/0247;
(Continued)

(56) References Cited

U.S. PATENT DOCUMENTS 2,050,392 A 8/1936 Starr
3,508,530 A 4/1970 Clawson
(Continued)

FOREIGN PATENT DOCUMENTS

CN 102333944 A 1/2012
CN 106014694 A 10/2016
(Continued)

OTHER PUBLICATIONS

Gussak, L.A., et al.; "The Application of Lag-Process in Prechamber Engines," SAE Paper 790692, Society of Automotive Engineers, 1980, pp. 2355-2380.
(Continued)

*Primary Examiner* — Loren C Edwards
(74) *Attorney, Agent, or Firm* — Harness, Dickey & Pierce, PLC

(57) ABSTRACT

An internal combustion engine includes a camshaft operably adjusted by a phaser. Another aspect includes an internal combustion engine having an actuation system for an air valve. A further aspect provides a camshaft-in-camshaft system with a cam phaser located adjacent opposite ends. In another aspect, an internal combustion engine apparatus includes multiple nested camshafts with one of the camshafts having a cam configured to actuate an air intake valve associated with a turbulent jet ignition prechamber, and another of the camshafts having a cam configured to actuate an air valve of a main piston combustion chamber, the nested camshafts being independently rotatable by separate electromagnetic actuators.

35 Claims, 14 Drawing Sheets

Related U.S. Application Data

(60) Provisional application No. 63/227,503, filed on Jul. 30, 2021.

(51) Int. Cl.
*F01L 1/047* (2006.01)
*F01L 1/344* (2006.01)
*F01L 1/352* (2006.01)
*F01L 1/053* (2006.01)

(52) U.S. Cl.
CPC ..... *F01L 1/3442* (2013.01); *F01L 1/352* (2013.01); *F01L 2001/0473* (2013.01); *F01L 2001/0537* (2013.01)

(58) Field of Classification Search
CPC ..... F01L 2001/0471; F01L 2001/0473; F01L 2001/0475; F01L 2001/0537; F01L 1/34; F01L 1/344; F01L 1/34413; F01L 1/3442; F01L 2001/34496; F01L 1/352; F01L 2001/3521; F01L 2001/3522; F02B 19/00–19/18
See application file for complete search history.

(56) References Cited

U.S. PATENT DOCUMENTS

| | | | |
|---|---|---|---|
| 3,805,747 | A | 4/1974 | Nakagawa et al. |
| 3,924,592 | A | 12/1975 | Miyaki et al. |
| 3,957,021 | A | 5/1976 | Loyd, Jr. |
| 4,060,058 | A | 11/1977 | Hideg et al. |
| 4,259,932 | A | 4/1981 | Hideg et al. |
| 4,300,497 | A | 11/1981 | Webber |
| 4,332,224 | A | 6/1982 | Latsch et al. |
| 4,429,669 | A | 2/1984 | Burley |
| 4,592,318 | A | 6/1986 | Pouring |
| 5,036,669 | A | 8/1991 | Earleson et al. |
| 5,081,969 | A | 1/1992 | Long, III |
| 5,454,356 | A | 10/1995 | Kawamura |
| 5,520,864 | A | 5/1996 | Frei |
| 5,560,326 | A | 10/1996 | Merritt |
| 5,680,836 | A | 10/1997 | Pierik |
| 6,535,116 | B1 | 3/2003 | Zhou |
| 6,694,944 | B2 | 2/2004 | Agama et al. |
| 6,854,439 | B2 | 2/2005 | Regueiro |
| 6,953,020 | B2 | 10/2005 | Kojic et al. |
| 7,000,596 | B2 | 2/2006 | Zurloye et al. |
| 7,100,567 | B1 | 9/2006 | Bailey et al. |
| 7,107,964 | B2 | 9/2006 | Kojic et al. |
| 7,398,743 | B2 | 7/2008 | Fiveland |
| 7,584,739 | B2 | 9/2009 | Takahashi et al. |
| 7,647,904 | B2 | 1/2010 | Farah et al. |
| 8,051,818 | B2 | 11/2011 | Myers et al. |
| 8,062,976 | B2 | 11/2011 | Vecchione et al. |
| 8,371,257 | B2 | 2/2013 | Moon et al. |
| 8,584,636 | B2 | 11/2013 | David et al. |
| 8,857,405 | B2 | 10/2014 | Attard |
| 8,910,612 | B2 | 12/2014 | Woo et al. |
| 8,925,518 | B1 | 1/2015 | Riley et al. |
| 9,091,222 | B2 | 7/2015 | Furukawa |
| 9,305,901 | B2 | 4/2016 | Dropps |
| 9,376,955 | B2 | 6/2016 | Reitz et al. |
| 9,508,667 | B2 | 11/2016 | Prack |
| 9,653,886 | B2 | 5/2017 | Chiera et al. |
| 9,677,459 | B2 | 6/2017 | McClendon et al. |
| 9,799,617 | B1 | 10/2017 | Curiel et al. |
| 9,840,963 | B2 | 12/2017 | Chiera et al. |
| 9,856,848 | B2 | 1/2018 | Chiera et al. |
| 9,890,689 | B2 | 2/2018 | Hampson et al. |
| 9,893,497 | B2 | 2/2018 | Chiera et al. |
| 9,920,714 | B2 | 3/2018 | Ginter et al. |
| 10,054,102 | B2 | 8/2018 | Chiera et al. |
| 10,161,296 | B2 | 12/2018 | Schock et al. |
| 10,202,891 | B2 | 2/2019 | Oda et al. |
| 10,208,651 | B2 | 2/2019 | Tozzi et al. |
| 10,287,969 | B2 | 5/2019 | Boyde et al. |
| 10,337,397 | B2 | 7/2019 | Shelby et al. |
| 10,844,754 | B2 | 11/2020 | Weber et al. |
| 10,895,177 | B2 | 1/2021 | Chung et al. |
| 10,947,870 | B2 | 3/2021 | Kandolf et al. |
| 11,125,121 | B2 | 9/2021 | McCloy et al. |
| 11,187,142 | B2 | 11/2021 | Schock et al. |
| 11,408,329 | B2 | 8/2022 | Schock et al. |
| 11,466,608 | B2 | 10/2022 | Manfredi et al. |
| 2001/0042527 | A1 | 11/2001 | Uchida |
| 2005/0092181 | A1 | 5/2005 | Shih et al. |
| 2007/0151540 | A1 | 7/2007 | Takahashi et al. |
| 2007/0295295 | A1 | 12/2007 | Kobayashi et al. |
| 2008/0047511 | A1 | 2/2008 | Taye et al. |
| 2009/0132153 | A1 | 5/2009 | Shutty et al. |
| 2010/0140811 | A1 | 6/2010 | Leal et al. |
| 2011/0308495 | A1 | 12/2011 | Furukawa |
| 2011/0315102 | A1 | 12/2011 | David et al. |
| 2012/0103302 | A1 | 5/2012 | Attard |
| 2012/0118262 | A1 | 5/2012 | Johnson |
| 2012/0160217 | A1 | 6/2012 | Ashizawa |
| 2012/0161317 | A1 | 6/2012 | Rathburn |
| 2012/0222637 | A1* | 9/2012 | Neal ..... F01L 1/267 29/700 |
| 2013/0233273 | A1 | 9/2013 | Redtenbacher et al. |
| 2014/0144406 | A1 | 5/2014 | Schock et al. |
| 2014/0261298 | A1 | 9/2014 | Sasidharan et al. |
| 2015/0059456 | A1 | 3/2015 | Niessner et al. |
| 2015/0233280 | A1 | 8/2015 | Ernst et al. |
| 2016/0024994 | A1 | 1/2016 | Nayan |
| 2016/0146068 | A1 | 5/2016 | Haltiner et al. |
| 2016/0160741 | A1 | 6/2016 | Gu et al. |
| 2016/0230645 | A1 | 8/2016 | Schock et al. |
| 2017/0122184 | A1 | 5/2017 | Hampson et al. |
| 2017/0191406 | A1 | 7/2017 | Rabhi |
| 2017/0251713 | A1 | 9/2017 | Warner et al. |
| 2018/0266307 | A1 | 9/2018 | Muto |
| 2019/0136721 | A1 | 5/2019 | Wenger et al. |
| 2019/0277205 | A1 | 9/2019 | Geckler et al. |
| 2020/0149498 | A1 | 5/2020 | Loetz |
| 2020/0200068 | A1 | 6/2020 | Schock et al. |
| 2021/0189946 | A1 | 6/2021 | Schock et al. |
| 2021/0207523 | A1 | 7/2021 | Guisasola |
| 2021/0231064 | A1 | 7/2021 | Harshe et al. |
| 2021/0355860 | A1 | 11/2021 | Lejon et al. |
| 2021/0363913 | A1 | 11/2021 | Schock |

FOREIGN PATENT DOCUMENTS

| | | | | |
|---|---|---|---|---|
| CN | 110318900 | A | 10/2019 | |
| DE | 10-2005039713 | A1 | 2/2007 | |
| FR | 2893673 | A1 | 5/2007 | |
| JP | 2002266644 | A | 9/2002 | |
| WO | WO-2015124829 | A1 * | 8/2015 | ..... F02B 19/1028 |
| WO | WO-2015/138987 | A1 | 9/2015 | |
| WO | WO-2017/042302 | A1 | 3/2017 | |
| WO | WO-2019/027800 | A2 | 2/2019 | |

OTHER PUBLICATIONS

Dainton, L.; "Nikolai Nikolaevich Semenov. Apr. 16, 1896-Sep. 25, 1986," Biographical Memoirs of Fellows of the Royal Society, vol. 36, Dec. 1, 1990, pp. 527-543.

Oppenheim, A. K.; "Prospects for Combustion in Piston Engines," SAE 2002-01-0999, Society of Automotive Engineers, Mar. 4-7, 2002, 17 pages.

Toulson, E.; Thesis: "Applying Alternative Fuels in Place of Hydrogen to the Jet Ignition Process," The Department of Mechanical Engineering, the University of Melbourne, 2008, 402 pages.

Toulson, E., et al.; "Gas Assisted Jet Ignition of Ultra-Lean LPG in a Spark Engine," SAE 2009-01-0506, SAE International, 2009, 21 pages.

Toulson, E., et al.; "Modeling Alternative Prechamber Fuels in Jet Assisted Ignition of Gasoline and LPG," SAE 2009-01-0721, SAE International, 2009, 19 pages.

Attard, W., et al.; "A Turbulent Jet Ignition Pre-Chamber Combustion System for Large Fuel Economy Improvements in a Modern

(56) References Cited

OTHER PUBLICATIONS

Vehicle Powertrain," SAE 2010-01-1457, SAE Int. J. Engines, vol. 3, Issue 2, May 5, 2010, pp. 20-37.
Ma, J., et al.; "Adaptive Control of a Pneumatic Valve Actuator for an Internal Combustion Engine," IEEE Transactions on Control Systems Technology, 2010, 14 pages.
Attard, W., et al.; "Flame Kernel Development for a Spark Initiated Pre-Chamber Combustion System Capable of High Load, High Efficiency and Near Zero NOx Emissions," SAE 2010-01-2260, SAE Int. J. Engines, vol. 3, Issue 2, Oct. 25, 2010, pp. 408-427.
Toulson, E., et al.; "A Review of Pre-Chamber Initiated Jet Ignition Combustion Systems," SAE 2010-01-2263, SAE International, Oct. 25, 2010, 24 pages.
Mahle, "Turbulent Jet Ignition pre-chamber initiated combustion system supports high efficiency and near-zero engine-out NOx in naturally aspirated PFI engine," Green Car Congress, http://www.greencarcongress.com/2010/10/tji-20101027.html, published Oct. 27, 2010, 5 pages.
Attard, W., et al.; "A New Combustion System Achieving High Drive Cycle Fuel Economy Improvements in a Modern Vehicle Powertrain," SAE 2011-01-0664, SAE International, Apr. 12, 2011, 23 pages.
Ma, J., et al.; "Adaptive Control of a Pneumatic Valve Actuator for an Internal Combustion Engine," IEEE Transactions of Control Systems Technology, vol. 19, No. 4, Jul. 2011, pp. 730-743.
Attard, W.; "A Single Fuel Pre-Chamber Jet Ignition Powertrain Achieving High Load, High Efficiency and Near Zero NOx Emissions," JSAE 20119100, SAE 2011-01-2023, SAE International, 2011, pp. 734-746.
Attard, W., et al.; "Spark Ignition and Pre-Chamber Turbulent Jet Ignition Combustion Visualization," SAE 2012-01-0823, SAE International, Apr. 16, 2012, 16 Pages.
Attard, W., et al.; "A Lean Burn Gasoline Fueled Pre-Chamber Jet Ignition Combustion System Achieving High Efficiency and Low NOx at Part Load," SAE 2012-01-1146, SAE International, Apr. 16, 2012, 14 pages.
Toulson, E., et al.; "Visualization of Propane and Natural Gas Spark Ignition and Turbulent Jet Ignition Combustion," SAE 2012-32-0002, SAE Int. J. Engines, vol. 5, Issue 4, Dec. 2012, 15 pages.
Schock, H., "Option #1: Air Injector and Fuel Injector Used," DOE presentation, Feb. 2015.
"Delphi Variable Cam Phaser," Powertrain Systems, Delphi, Published Jul. 26, 2017, pp. 1-3.
"Exhaust Gas Recirculation," Wikipedia, https://en.wikipedia.org/wiki/Exhaust_gas_recirculation, printed Jul. 26, 2017, four pages.
Toulson, E., et al.: "Advanced Combustion Engines / 2015 Annual Report," Vehicle Technologies Office, Michigan State University, U.S. Department of Energy, 2015, pp. 162-166.
Gunther, M., et al., "Ignition Systems for Gasoline Engines," IAV Automotive Engineering, 4$^{th}$ International Conference, Dec. 6-7, 2018, Germany.
PCT Search Report for Application PCT/US22/38767 mailed Jun. 22, 2023.
Schneider, F., et al., "Variable Valve Timing for Engine Concept," MTZ, vol. 69, May 2008.
Magda, M., "In the cam," Valve Trains, Engine Technology International.com, Jun. 2011.

* cited by examiner

ACTUATION SYSTEM FOR AN INTERNAL COMBUSTION ENGINE

CROSS-REFERENCE TO RELATED APPLICATIONS

This application is a continuation of PCT patent application serial no. PCT/US2022/038767, filed on Jul. 29, 2022, which claims priority to U.S. provisional patent application Ser. No. 63/227,503, filed on Jul. 30, 2021, both of which are incorporated by reference herein.

GOVERNMENT RIGHTS

This invention was made with government support under W56HZV-21-C-0034 awarded by the TACOM MCA. The government has certain rights in the invention.

BACKGROUND AND SUMMARY

The present application generally pertains to internal combustion engines and more particularly to an actuation system for an internal combustion engine.

It is known to experiment with internal combustion engines having a combustion prechamber, separate from a main combustion chamber or piston cylinder. See, for example, U.S. Pat. No. 10,161,296 entitled "Internal Combustion Engine" which issued to common inventor Schock et al. on Dec. 25, 2018; PCT International Patent Publication No. WO 2019/027800 entitled "Diesel Engine with Turbulent Jet Ignition" which was commonly invented by Schock et al.; and U.S. patent application Ser. No. 17/322,999 filed on May 18, 2021 which was commonly invented by Schock. All of these are incorporated by reference herein. While these prior turbulent jet ignition configurations are significant improvements in the industry, additional improvements are desired to reduce parts and their associated expense, and to more concisely package the components, while achieving improved fuel efficiencies.

Furthermore, the use of multiple cam phasers on a concentric camshaft has recently been commercialized. Examples of such conventional multiple cam phaser devices are disclosed in U.S. Pat. No. 11,125,121 entitled "Dual Actuating Variable Cam" which issued to McCloy, et al. on Sep. 21, 2021; U.S. Pat. No. 10,947,870 entitled "Coupling for a Camshaft Phaser Arrangement for a Concentric Camshaft Assembly" which issued to Kandolf, et al. on Mar. 16, 2021; U.S. Pat. No. 10,844,754 entitled "Camshaft Adjusting System having a Hydraulic Camshaft Adjuster and an Electric Camshaft Adjuster" which issued to Weber, et al. on Nov. 24, 2020; and U.S. Pat. No. 8,051,818 entitled "Dual Independent Phasing System to Independently Phase the Intake and Exhaust Cam Lobes of a Concentric Camshaft Arrangement" which issued to Myers, et al. on Nov. 8, 2011. All of these patents are incorporated by reference herein.

These conventional systems mount both of their cam phasers at the same end of the camshafts. This can create packaging difficulties of the engine assembly. Furthermore, this traditional arrangement adds extra complexity to the phaser assemblies. It is also disadvantageous that these conventional multiple cam phaser patents do not operate a turbulent jet ignition prechamber with a cam phaser.

In accordance with the present invention, an internal combustion engine includes a camshaft operably adjusted by a phaser. Another aspect includes an internal combustion engine having an actuation system for an air valve. A further aspect provides a camshaft-in-camshaft system with a cam phaser located adjacent opposite ends. In another aspect, an internal combustion engine apparatus includes multiple nested camshafts with each camshaft being movable by an electromagnetic device, for example electric motors and gear boxes, at the same or opposite ends of the nested camshaft assembly. A further aspect of an internal combustion engine apparatus includes multiple nested camshafts with one of the camshafts having a cam configured to actuate an air intake valve associated with a turbulent jet ignition prechamber, and another of the camshafts having a cam configured to actuate an air valve of a main piston combustion chamber, the nested camshafts being independently rotatable by separate electromagnetic actuators. Methods of manufacturing and using an internal combustion engine that employs multiple nested camshafts with multiple associated cam phasers, are also provided.

The present apparatus is advantageous over conventional devices. The present apparatus achieves superior positional control and rotational accuracy of one or more of the cams. As a non-limiting example, one rotation of the electric motor of the cam phaser provides approximately one to three degrees, and more preferably two degrees, of rotation of the associated cam. This is expected to improve engine operating efficiencies and power output. The present apparatus also beneficially allows independent movement of multiple cams, at least in one operating condition, along the same co-axial camshaft location. Furthermore, the present nested camshafts and multiple associated cam phasers advantageously work well in cold and hot temperature conditions, as contrasted to poor performance and high emissions of traditional hydraulic phasers in cold weather. Additional advantageous and features of the present system and method will become apparent from the following description and appended claims, taken in conjunction with the accompanying drawings.

DETAILED DESCRIPTION

Figure 1:
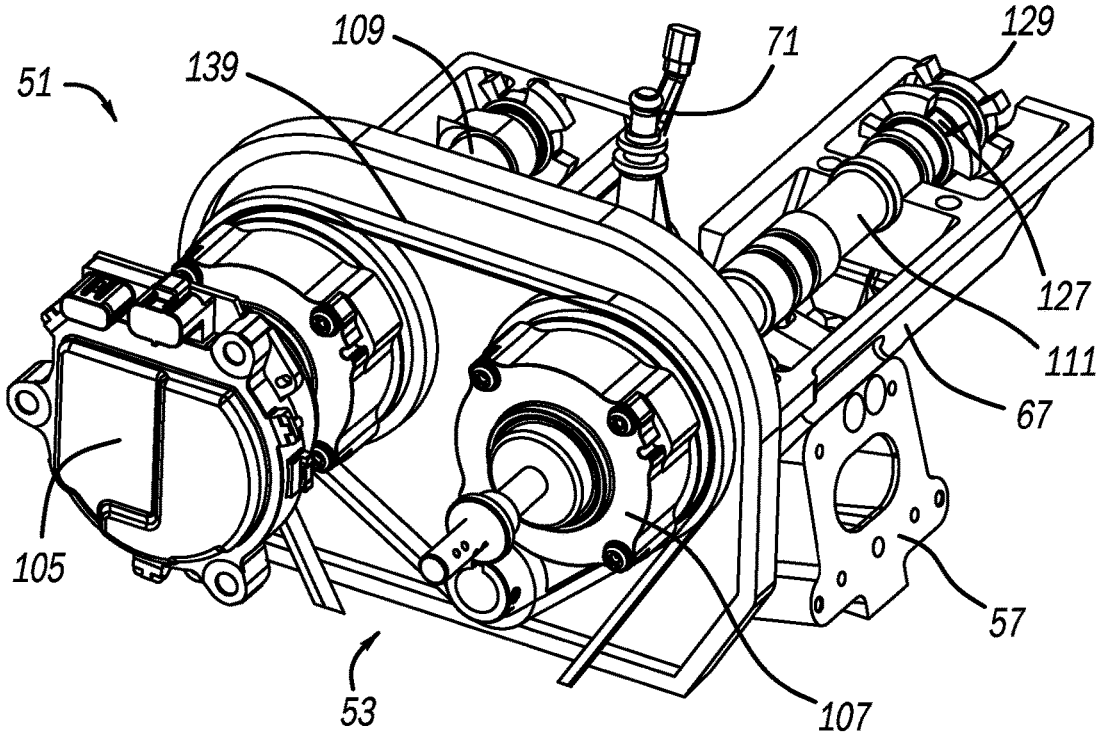
FIG. 1 is a front perspective view of the present apparatus including a cylinder head configuration with electrical and hydraulic cam phasers.

A first preferred embodiment of the present apparatus 51 includes an actuation system 53 for an air valve 55 of an internal combustion engine 57, as is illustrated in FIGS. 1-8 and 11-13. The apparatus further includes a dual mode, turbulent jet ignition ("DM-TJI") pre-chamber 59, in addition to a main combustion chamber 61 between the pre-chamber and a piston 63. The DM-TJI uses radially directed reacting jets to ignite a high-exhaust gas recirculation ("EGR") primary mixture. The turbulent jet ignition system is preferably part of a preassembled and self-contained cartridge 65, but may alternately be separately assembled to or part of an engine cylinder head 67. The present apparatus employs a highly-dilute SI engine combustion methodology enabling this methodology for gaseous and liquid fueled engines. The cartridge includes an ignitor 69 such as a spark or glow plug, a fuel injector 71, air valve 55 and a pre-chamber cavity 73. An air conduit 75 transmits fresh air to air inlet valve assembly 55 of the pre-chamber. When combined with a Miller cycle engine, this fuel-tolerant combustion system has the potential to produce peak Brake Thermal Efficiency ("BTE") greater than 45% and efficiencies greater than 40% over a wide range of operation. Stable operation with 50% intake EGR is expected in a single-cylinder gasoline fueled engine.

The cartridge has pre-chamber air valve 55 whose opening can be controlled by a number of types of actuators, including electronic, pneumatic, hydraulic or mechanical. The advantage of a cam acting mechanical system is that it is very energy efficient compared to other options. When a camshaft delivers force to a spring-valve assembly and opens it, much of the potential energy stored in the spring is returned via the cam to the system upon closing. Camshafts are employed for opening and closing intake and exhaust valves on the internal combustion engine.

The present apparatus for opening the intake pre-chamber valve 55 of the TJI cartridge assembly 59 uses a nested and concentric arrangement of multiple co-axial camshafts 101 and 103. This concentric cam arrangement may be used on either the intake, exhaust or a common camshaft but for simplicity, a system on the intake cam is described. FIG. 1 shows the front of the assembly with an electrical cam phaser 105 and a hydraulic cam phaser 107. In this embodiment electrical cam phaser 105 is on an exhaust cam 109 and hydraulic cam phaser 107 on an intake cam assembly 111, such that either can be independently phased or rotationally adjusted relative to the other.

Figure 2:
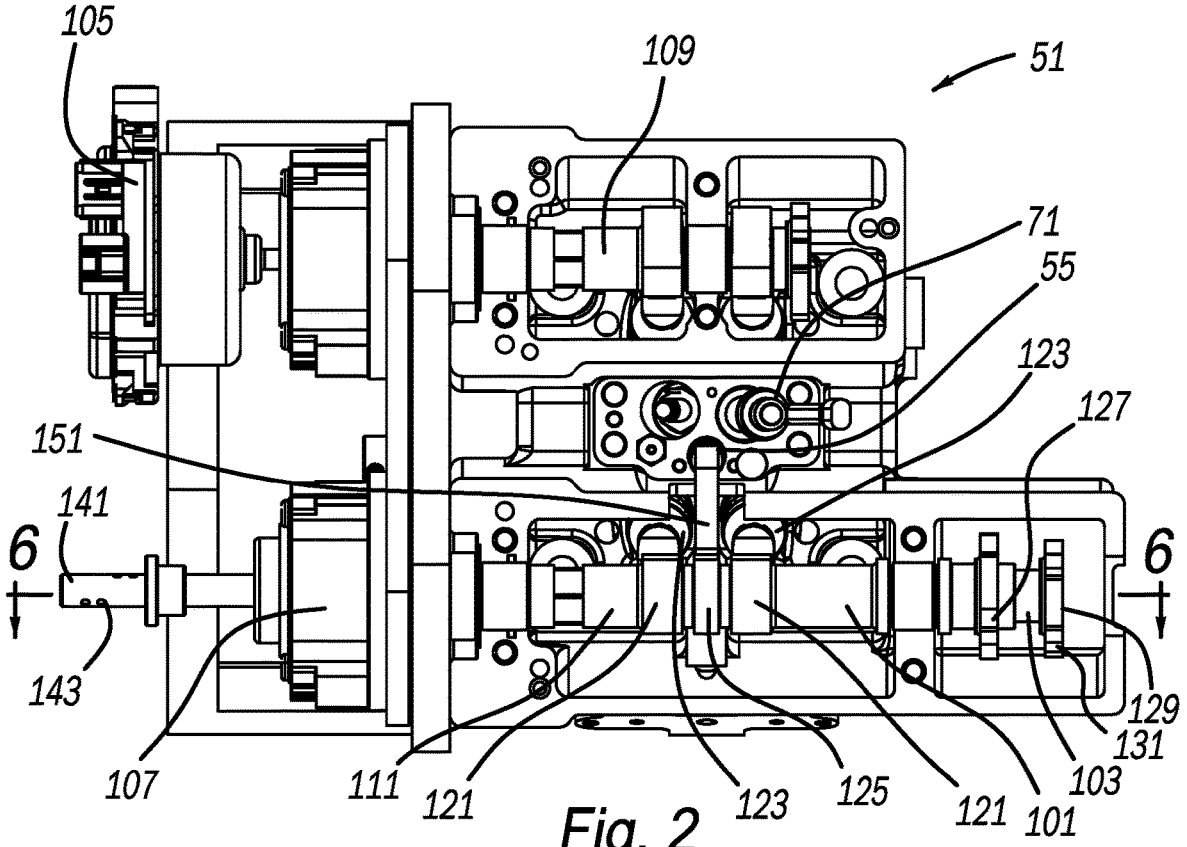
FIG. 2 is a top elevational view of the present cylinder head configuration showing the electrical phases and hydraulic phasers.

FIG. 2 shows electrical phaser 105 on the upper part of the figure and hydraulic phaser 107 on the lower part of the figure. The hydraulic phaser is configured to operate concentrically nested camshafts 101 and 103, as can be observed in FIGS. 2 and 6-8. That is, as assembled, cam lobes 121 of an outer camshaft 101 are operating traditional primary air intake valves 123, associated with and having a valve seat located in primary piston combustion chamber 61 (see FIG. 12), and cam lobes 125 of inner camshaft 103 operating cartridge air intake valve 55.

On intake cam assembly 111, timing gear assemblies are used as a position indicators. More specifically, an outer cam timing wheel 127 is concentrically mounted to outer camshaft 101 for rotation therewith. Similarly, an inner cam timing wheel 129 is concentrically mounted to inner camshaft 103 for rotation therewith. Each timing wheel has multiple circumferentially spaced apart protrusions 131 and 133 outwardly radiating from an inner circular base; the timing wheels are longitudinally spaced apart from each other and adjacent distal ends of the nested camshafts opposite phaser 107. Position sensors are also used but not shown.

It is noteworthy that both inner and outer camshafts 103 and 101, respectively, are driven by dual phaser 107 on the same proximal ends of the camshafts and on only a single end of engine head 67. Furthermore, either the exhaust or the intake cam could employ a concentric cam assembly and either could actuated by hydraulic or electric phasers. Electric phaser 105 includes an electromagnetic actuator, more particularly, an electric motor and associated gear box having planetary gears therein driven by the motor.

Figure 3:
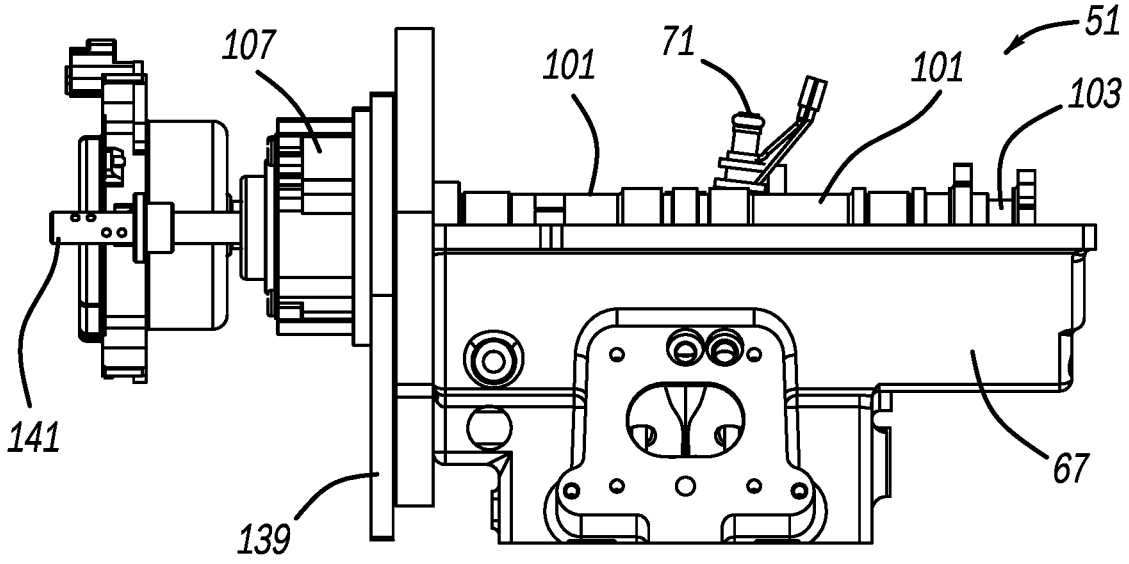
FIG. 3 is a side elevational view of the present cylinder head with the dual acting and nested camshafts.

FIGS. 2 and 3 illustrate a hydraulic phaser shaft 141 showing a hydraulic oil input and output for primary intake valves 123 and the dots 143 showing the hydraulic oil input for inner cam 103 which actuates valve 55 on the prechamber cartridge. Input and output passageways inside shaft 141 serve as an oil manifold to the dual acting hydraulic phaser.

Figure 4:
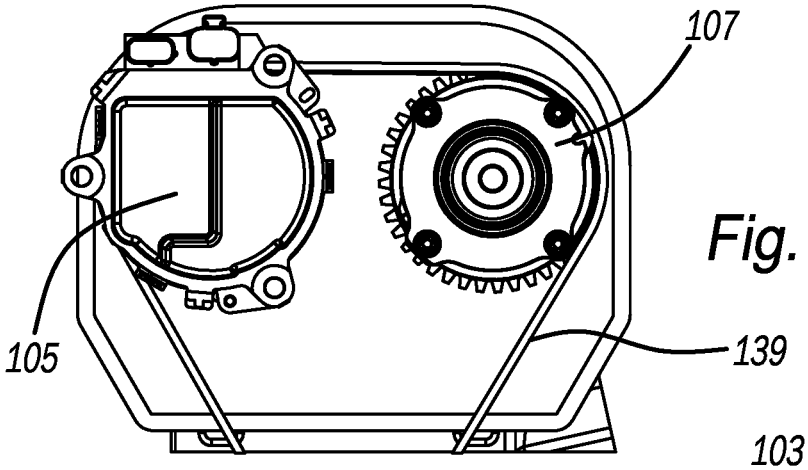
FIG. 4 is a front elevational view of the present cylinder head illustrating belt driven exhaust and intake camshafts.

FIG. 4 shows a belt providing energy to both the intake and exhaust cams and a view from the back of the assembly. A closed loop driver 139, more specifically the belt or a chain, is rotated by a sprocket or pulley driven by a primary crankshaft which, in turn, is rotated by pistons 63. Sprockets or pulleys associated with valve camshaft assemblies 109 and 111 engage with closed loop driver 139, for operably rotating these camshafts in a nominal operating condition (which may or may not be additionally angularly adjusted or phased). The inner camshaft operably rotates independently from the outer driven camshaft when adjusted by the phaser. Cam phasers on both the front and back of a concentric cam will be discussed hereinafter.

Figure 5:
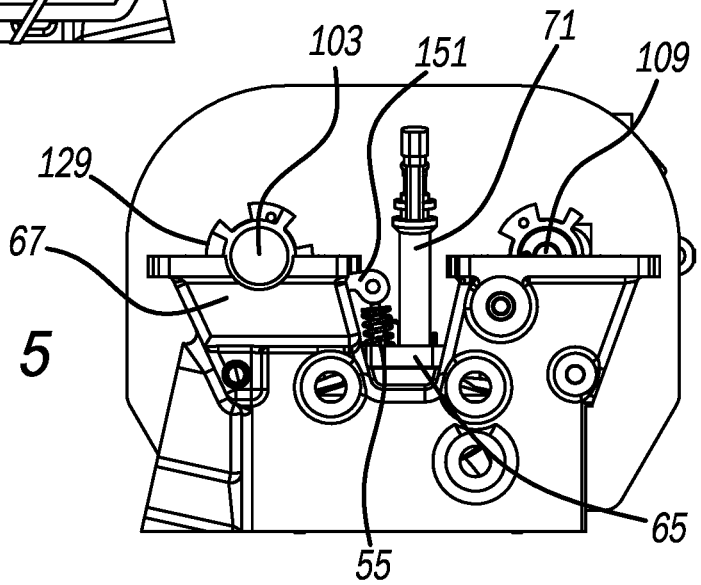
FIG. 5 is a rear elevational view of the present cylinder head illustrating belt driven exhaust and intake camshafts.
Figure 6:
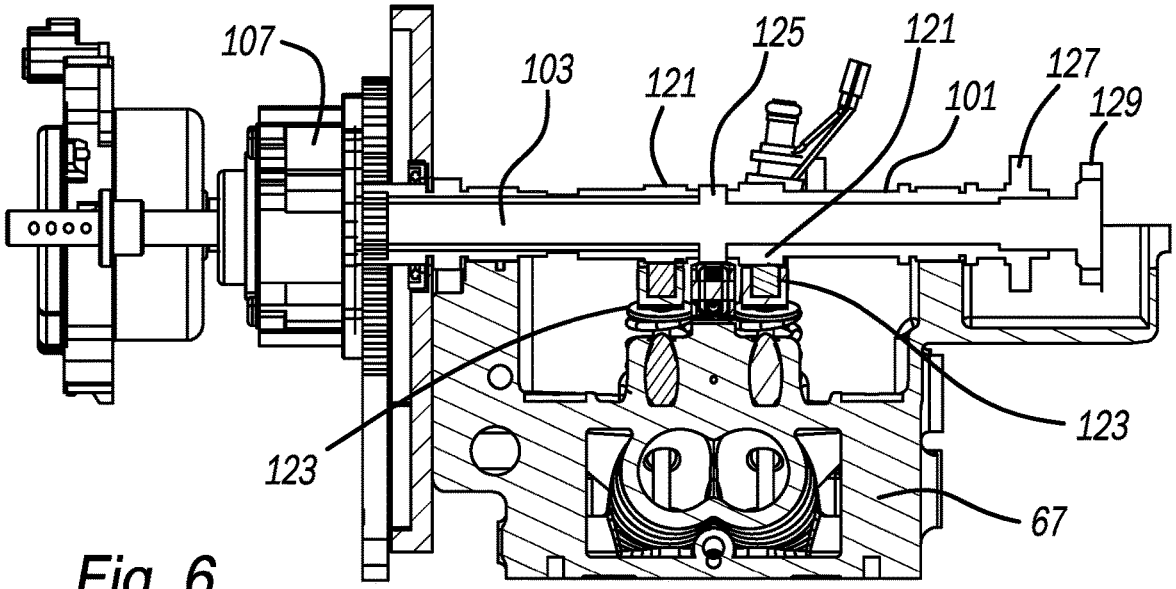
FIG. 6 is a cross-sectional view, taken along line 6-6 of FIG. 2, showing the present cylinder head illustrating the nested intake dual acting camshafts.
Figure 7:
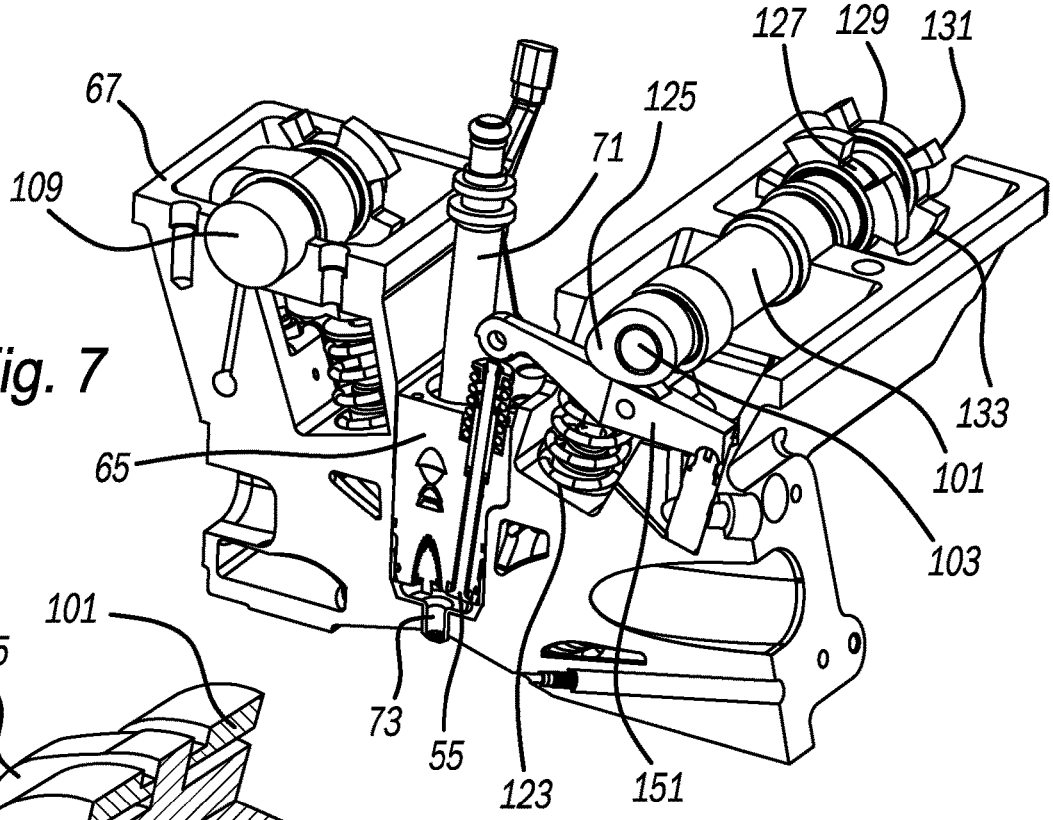
FIG. 7 is a fragmentary perspective view of the present apparatus showing how a purge valve is operated from an inner cam assembly.
Figure 8:
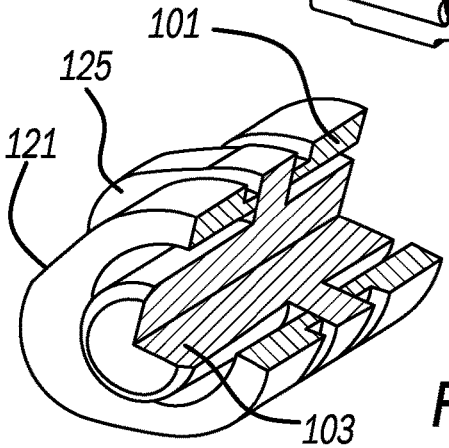
FIG. 8 is a fragmentary perspective view of the present apparatus illustrating the nested intake dual acting camshafts.

Referring to FIGS. 2, 5 and 7, a prechamber valve rocker arm 151 and concentric cam assembly are arranged to operate on either the intake or the exhaust cam side. Since prechamber cartridge 65 is laterally offset from rotational axes of nested intake camshafts 101 and 103, and is also laterally offset from a rotational axis of exhaust camshaft 109 in a preferred exemplary configuration, rocker arm 151 seals in a valley between the two camshafts. Although this rocker arm sealing may not be needed in a redesigned head assembly.

Figure 9:
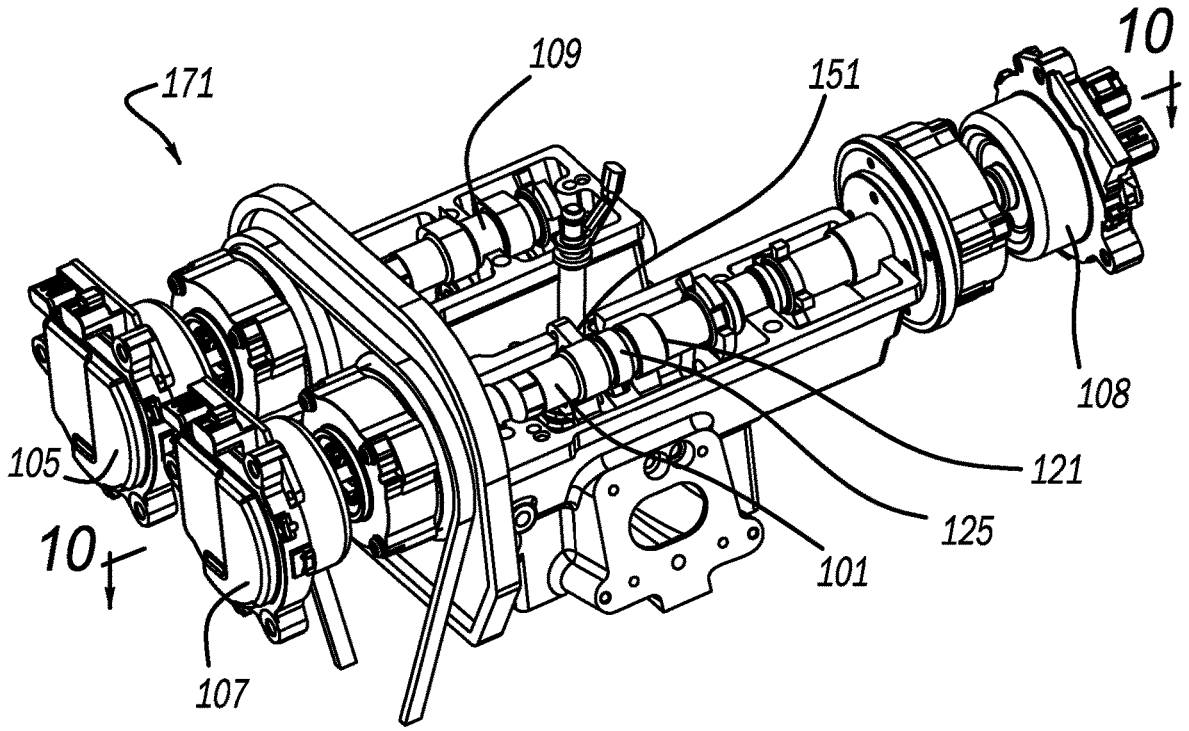
FIG. 9 is a perspective view of the present apparatus showing a second embodiment of the cylinder head with the dual cam equipped with an electric motor phaser on either end of the intake camshaft.
Figure 10:
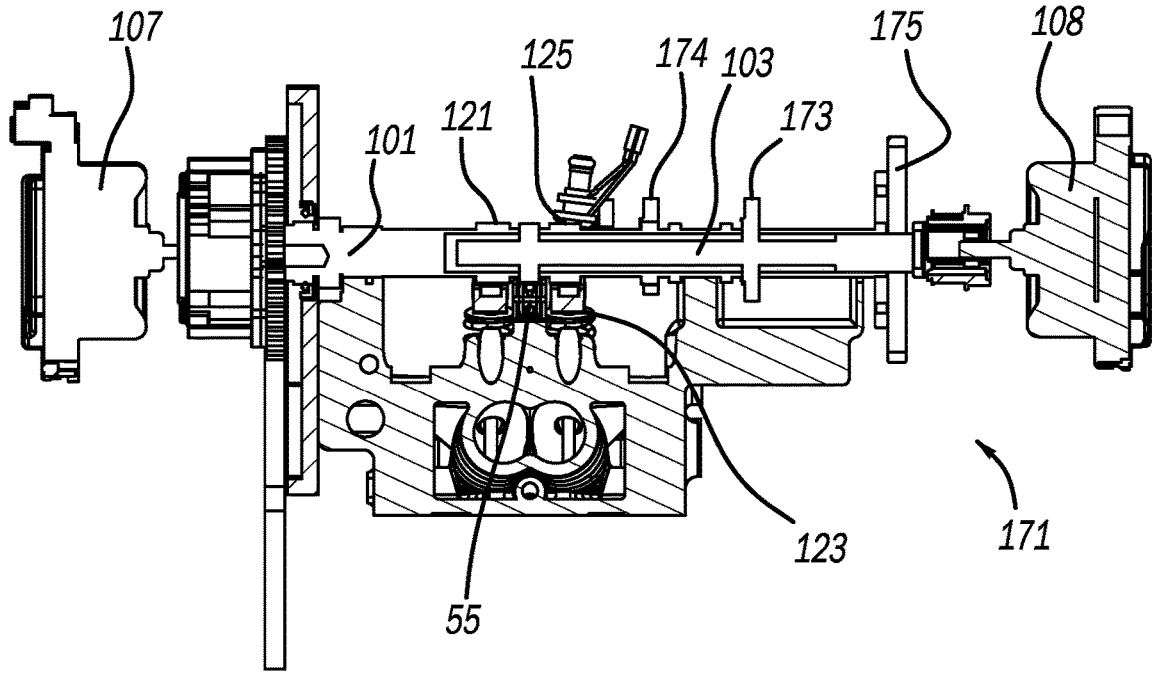
FIG. 10 is a cross-sectional view, taken along line 10-10 of FIG. 9, of the second embodiment of the present apparatus through a centerline of a cylinder head dual camshaft, showing the electric motor phaser on either end of the intake camshaft.
Figure 11:
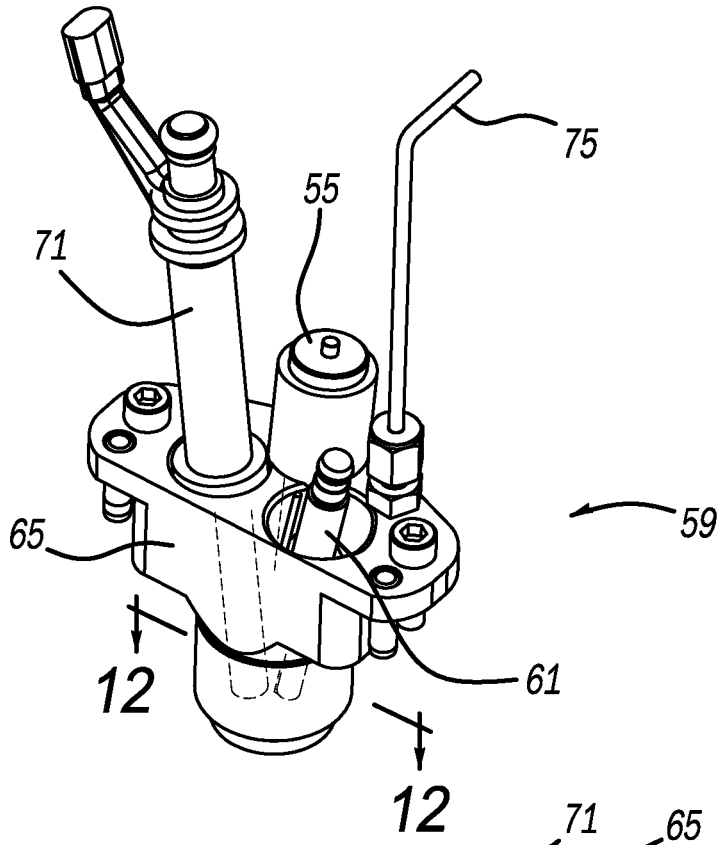
FIG. 11 is a perspective view of a prechamber cartridge assembly employed with the first and second embodiments of the present cylinder head apparatus.
Figure 12:
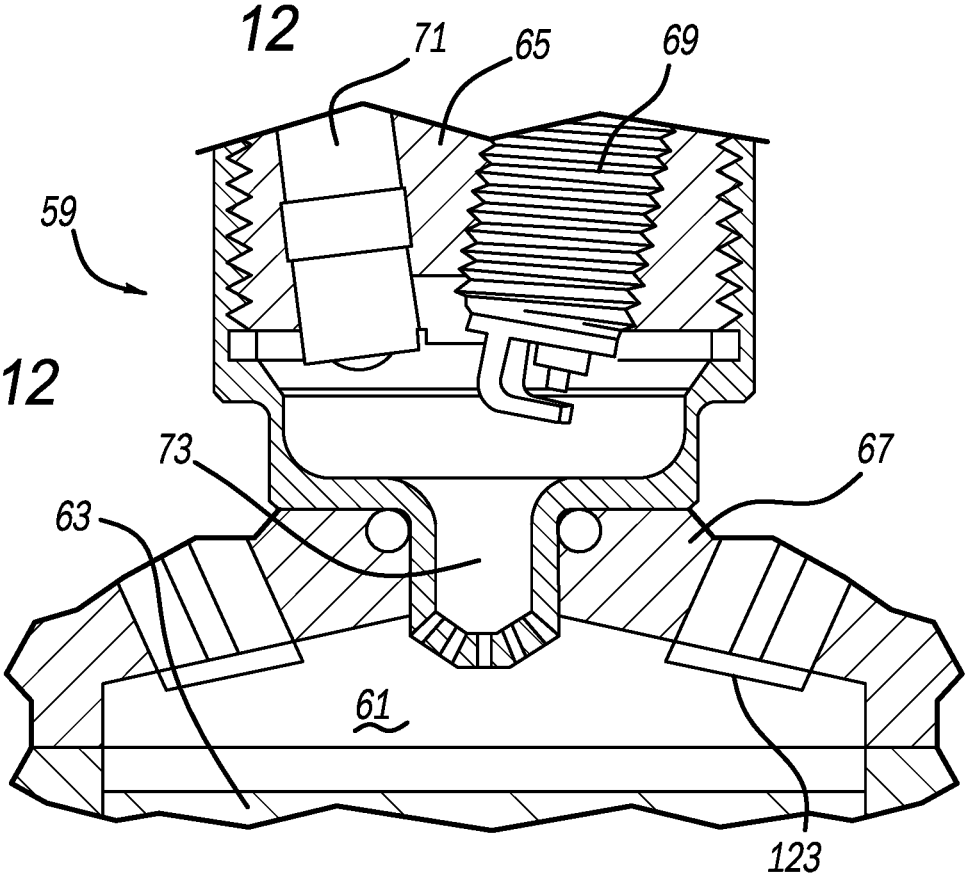
FIG. 12 is a cross-sectional view, taken along line 12-12 of FIG. 11, showing the prechamber cartridge assembly employed with the first and second embodiments of the present cylinder head apparatus.
Figure 13:
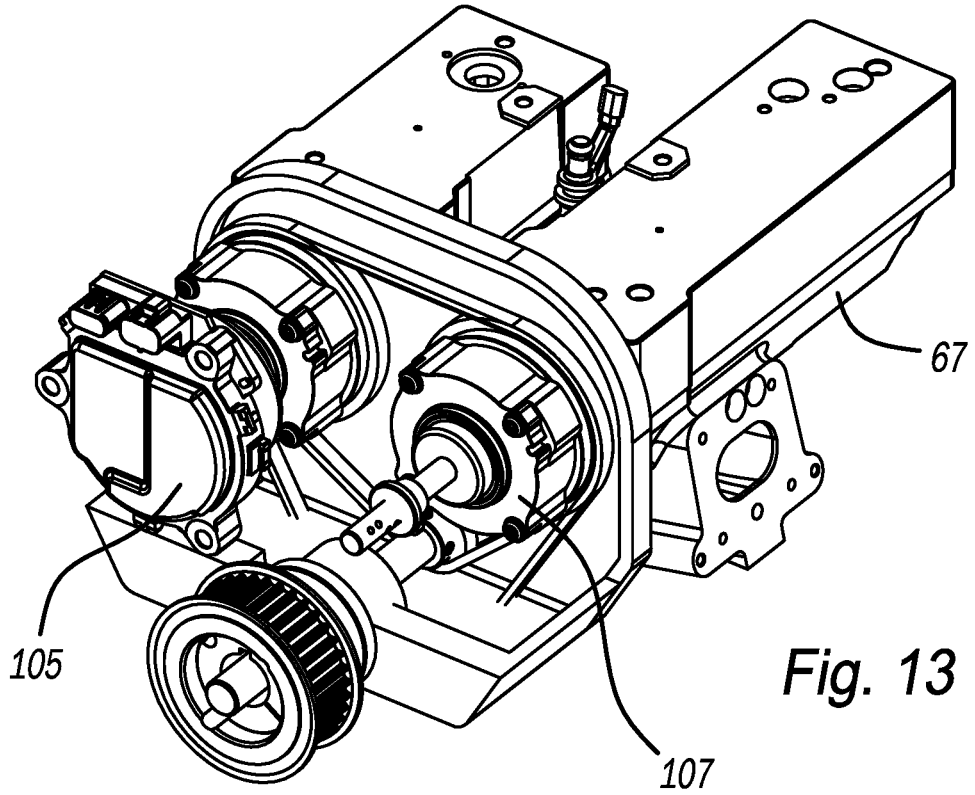
FIG. 13 is a perspective view showing the first embodiment of the present cylinder head apparatus.
Figure 15:
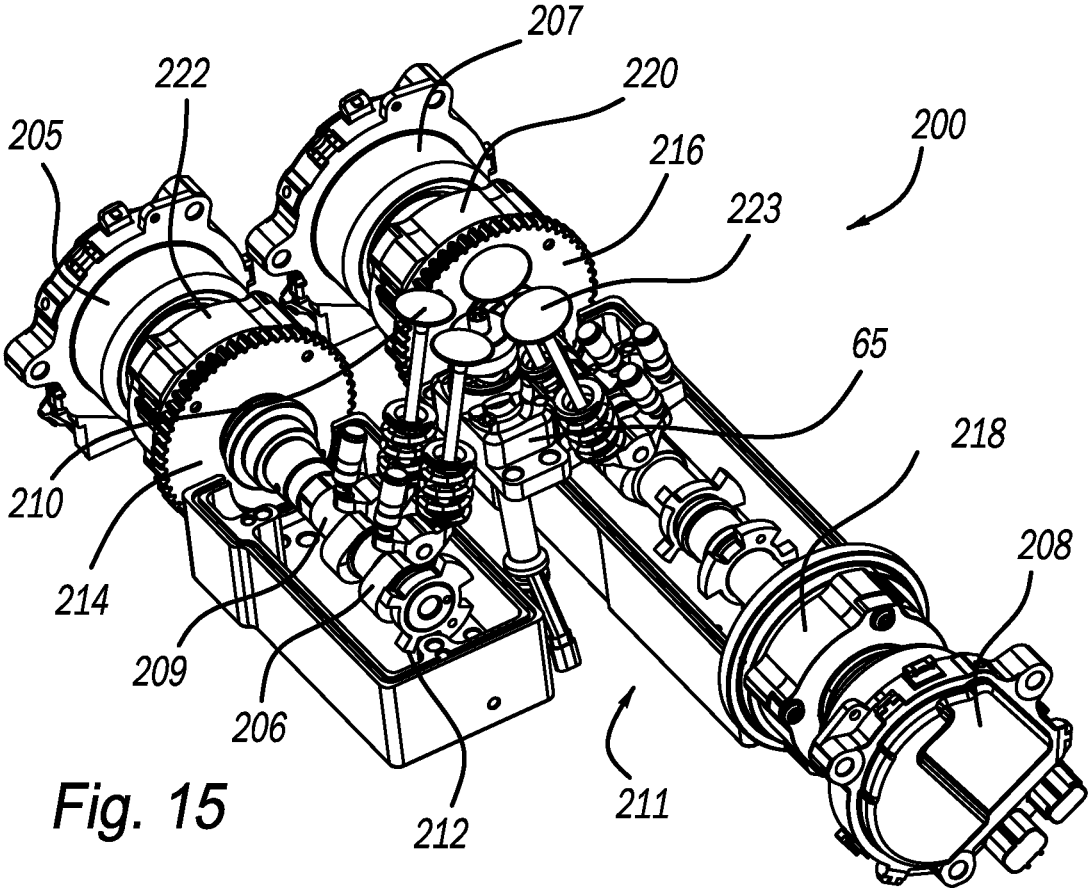
FIG. 15 is a bottom perspective view showing the third embodiment of the present cylinder head apparatus.
Figure 14:
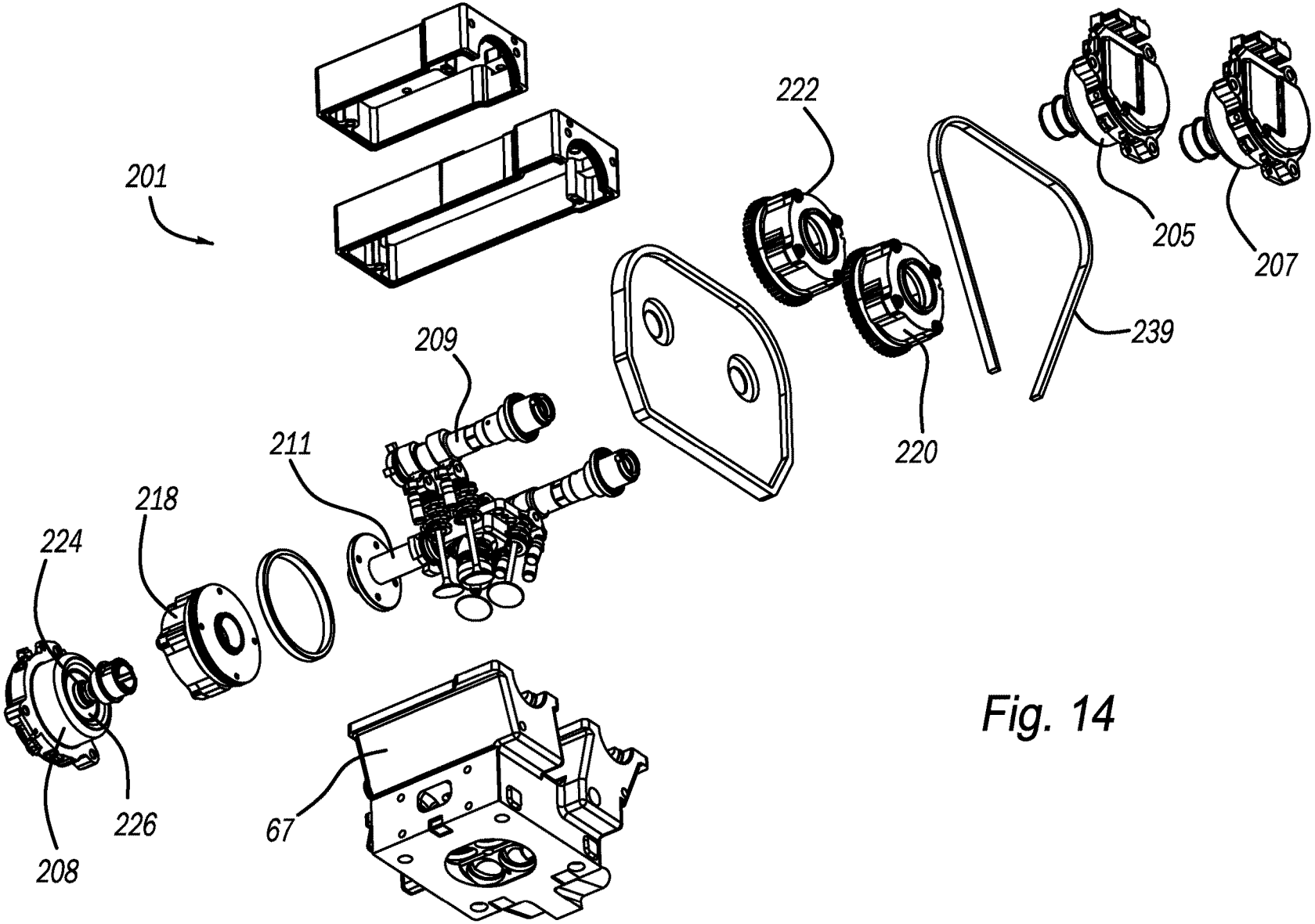
FIG. 14 is an exploded perspective view showing a third embodiment of the present cylinder head apparatus.
Figure 16:
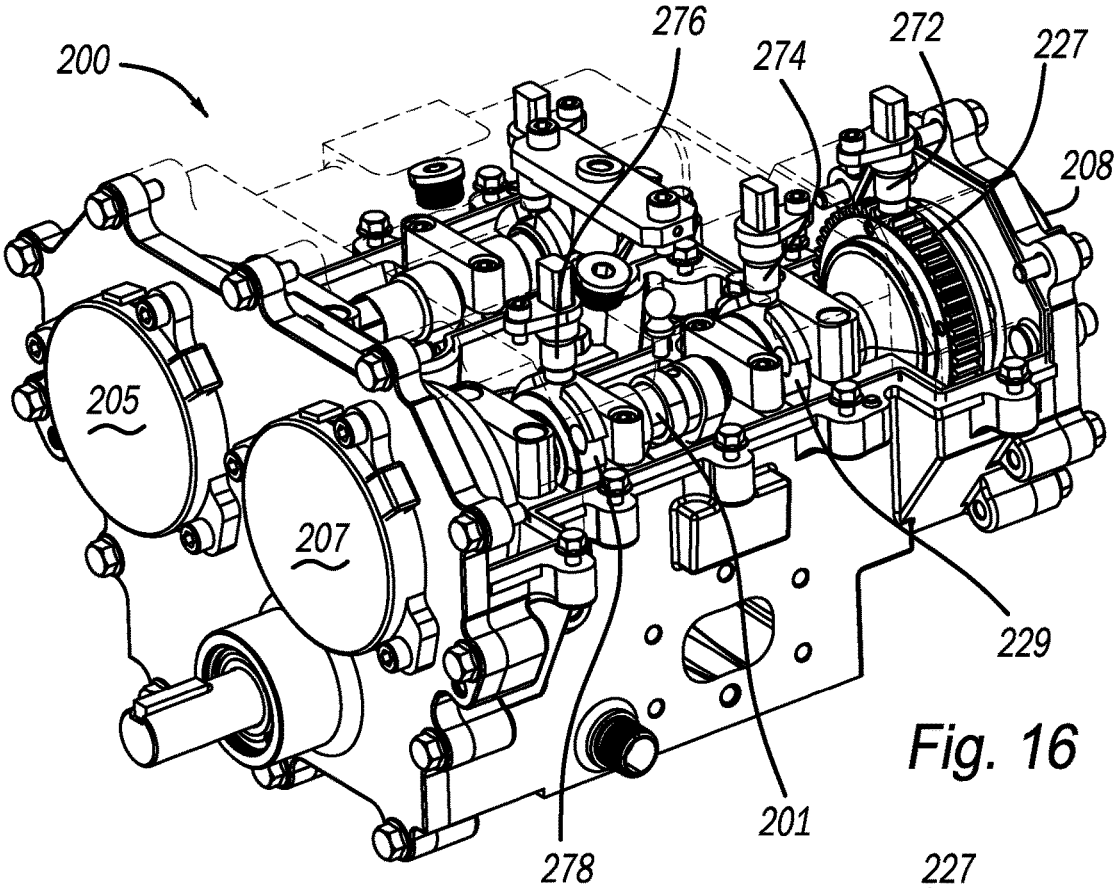
FIG. 16 is a top perspective view showing the third embodiment of the present cylinder head apparatus.

Furthermore, FIGS. 9 and 10 illustrate another embodiment of apparatus 171 where phaser 105 on exhaust cam 109, and one phaser 107 and 108 on each end of concentric cams 101 and 103, phasing the intake valves and the prechamber valve(s). The same actuation assemblies 107 and 108 are shown on both ends of the concentric cams 101 and 103, however, it is alternately envisioned that camshaft 103 having cam 125 driving prechamber valve 55 can be smaller than outer concentric camshaft 101, with cam 121 shown phasing primary intake valves 123. Either the inner or outer cams in the concentric cam assembly can be used for the primary intake valves or the prechamber valves. In the presently illustrated example, phaser 108 controls and rotates inner camshaft 103 relative to partially surrounding outer camshaft 103, which is driven by phaser 107. Phasers 105, 107 and 108 in this configuration are all preferably electric phasers. Nevertheless, in this application the concentric cam assemblies could alternately employ hydraulic phasers.

An intake timing wheel 173 rotating with inner camshaft 103, and a small outer timing wheel 174 and a larger radius timing wheel 175 rotating with outer camshaft 101, are also provided. An overhead cam arrangement is used in this description, however, the concentric cam and phasing concepts are equally applicable to a cam-in-block configuration using pushrods to activate valves.

Another embodiment of an internal combustion engine apparatus 200 can be observed in FIGS. 14-24. An electric motor driven phaser 205 and cam lobes 206 of associated exhaust camshaft 209 operably open (or close) spring biased, poppet type, air exhaust valves 210 for the primary piston combustion chamber. A timing wheel 212, having spaced apart radial protuberances, is mounted adjacent a distal end of exhaust camshaft 209 for rotation therewith. Moreover, an input wheel 214, such as a chain sprocket or belt pulley, is driven by a closed loop chain or belt driver 239. Input wheel 214 is mounted adjacent a proximal end of exhaust camshaft 209 for driving the camshaft during nominal unphased rotation.

A concentrically nested camshaft assembly 211 is on the air valve inlet side of the engine (although the nested camshaft assembly may instead or additionally be located on the exhaust side, in an alternate arrangement). The nested inlet camshaft assembly includes a hollow and longitudinally elongated outer camshaft 201 and a longitudinally elongated inner camshaft 203 (see FIG. 19). Outer camshaft 201 is selectively rotated by an electromagnetic front phaser 207 coupled thereto. Similarly, inner camshaft 203 is selectively rotated by an electromagnetic rear phaser 208, which is longitudinally adjacent an input wheel 216. Gear boxes 218, 220 and 222 are driven by central output shafts 224, rotated by rotors within the electric motors 226 of the phasers.

Figure 17:
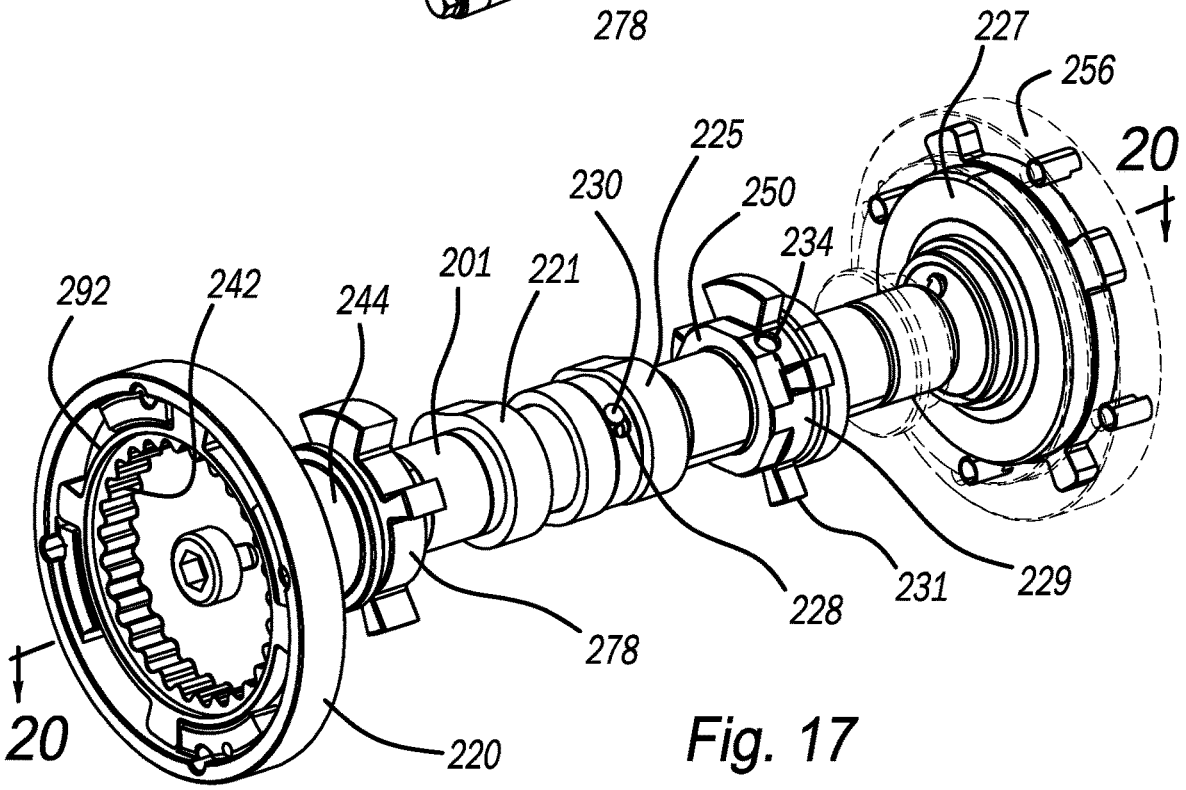
FIG. 17 is a perspective view showing a nested camshaft assembly employed in the third embodiment of the present cylinder head apparatus.
Figure 18:
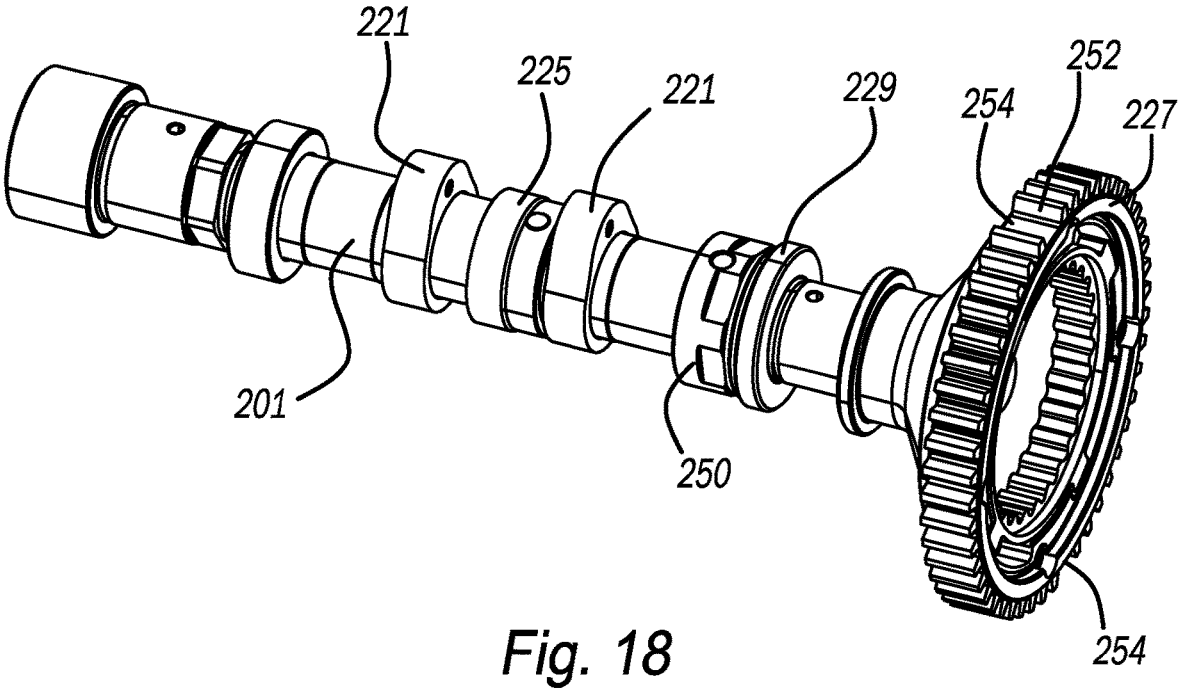
FIG. 18 is a perspective view, opposite that of FIG. 17, showing the nested camshaft assembly employed in the third embodiment of the present cylinder head apparatus.
Figure 19:
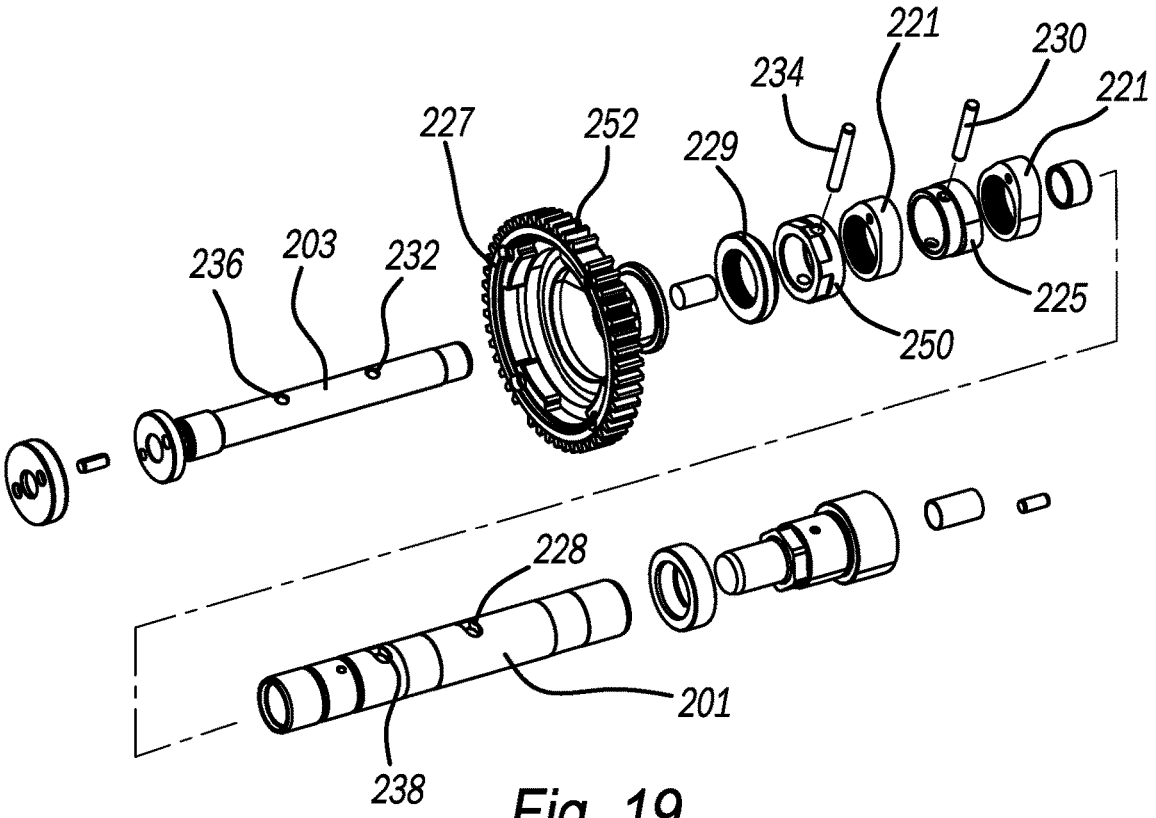
FIG. 19 is an exploded perspective view showing the nested camshaft assembly employed in the third embodiment of the present cylinder head apparatus.
Figure 20:
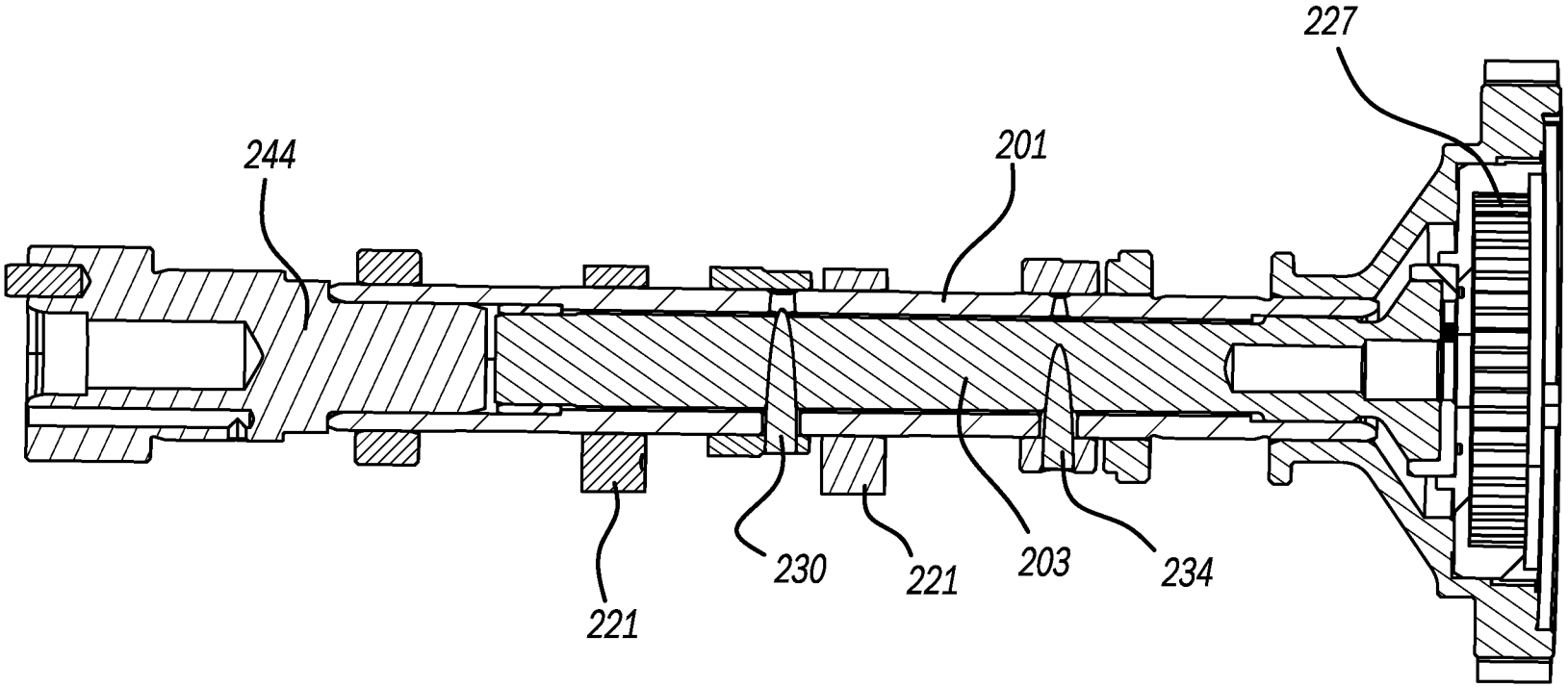
FIG. 20 is a cross-sectional view, taken along line 20-20 of FIG. 17, showing the nested camshaft assembly employed in the third embodiment of the present cylinder head apparatus.

Referring to FIGS. 17-19, outer camshaft 201 has circumferentially elongated, lost-motion slots 228 through which extend pins 230 affixed to and radially projecting from holes 232 in inner camshaft 203. These pins 230 securely mount eccentric cam lobes 225, via an adjacent ring, to inner camshaft 203, to provide adjusted offset phasing thereof, while still allowing these inner cam lobes 225 to otherwise rotate with outer camshaft 201. Inner cam lobes 225 directly contact against ends of air exhaust or purge valves associated with the primary piston combustion chamber in the present exemplary embodiment, or alternately, indirectly through a rocker arm, lever and/or push rod coupled to a valve assembly associated with the prechamber cartridge 65. Another pin 234 radially projects from another hole 236 in inner camshaft 203, which is received in a slot 238 in outer camshaft 201, to thereby couple an inner timing wheel 229 to the inner camshaft via a clamping collar 250. At least three protuberances 231, of different sizes, radially project from inner timing wheel 229 with circumferential gaps therebetween. An end of inner camshaft 203 is coupled to a planetary gear assembly 242 (also see FIG. 21) of gear box 220 associated with inner phaser 207, via an input coupling rod 244.

Cam lobes 221 are machined integral with or attached via clamps, pins or press-fit to outer camshaft 201 for rotation therewith. Outer cam lobes 221 directly contact against primary air intake valves 223 (see FIG. 15) for the primary piston combustion chamber. Furthermore, an outer timing wheel 227 is press-fit or otherwise securely mounted to an end of outer camshaft 201. At least twenty, and more preferably forty-eight teeth 252, radially project from a periphery of outer timing wheel 227, with uniformly sized valleys therebetween. At least one and more preferably two, circumferentially enlarged gaps 254 are located by pairs of the teeth. Outer timing wheel 227 is screwed onto a planetary gear assembly 256 of gear box 218 associated with phaser 208, which serves to adjust positioning of outer camshaft 201.

Hall-effect sensors 272, 274 and 276 magnetically detect the position and/or count rotations of the associated timing wheels 227, 229 and 278, respectively. The sensors send output signals to an engine microprocessor, which also accounts for ambient temperature and desired vehicle performance setting values, to control energization of phasers. Alternately, different types of sensors, such as optical or the like, may be employed.

Figure 21:
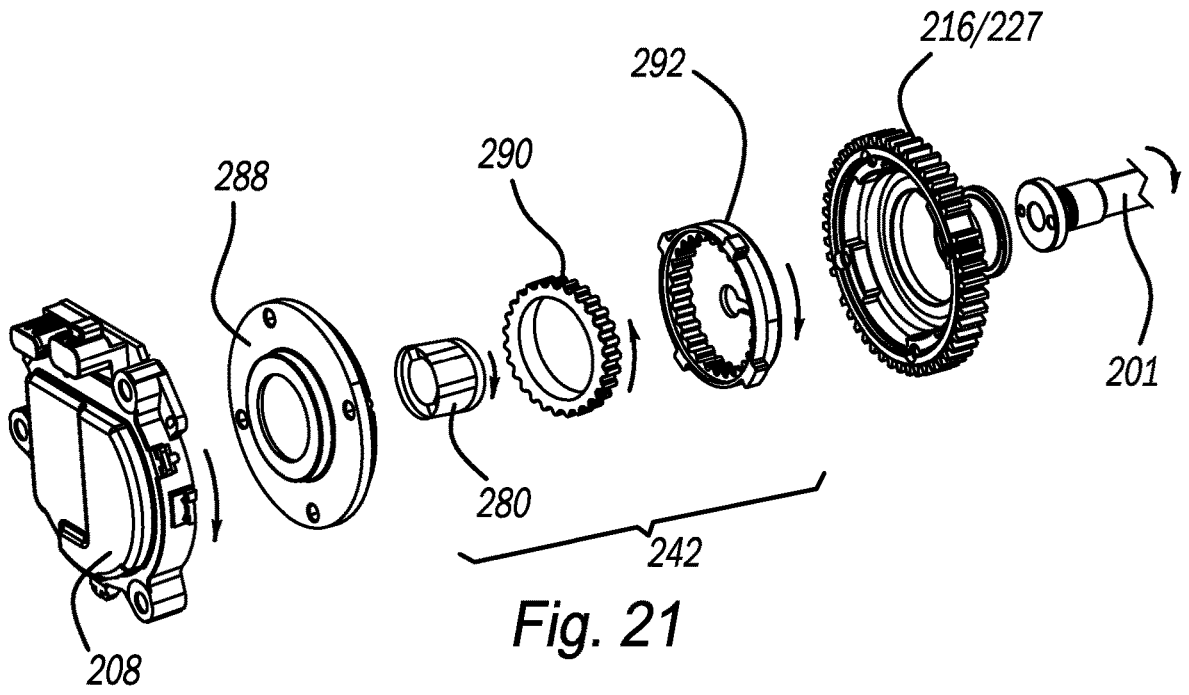
FIG. 21 is an exploded perspective view showing a phaser gear box assembly employed in the third embodiment of the present cylinder head apparatus.
Figure 22:
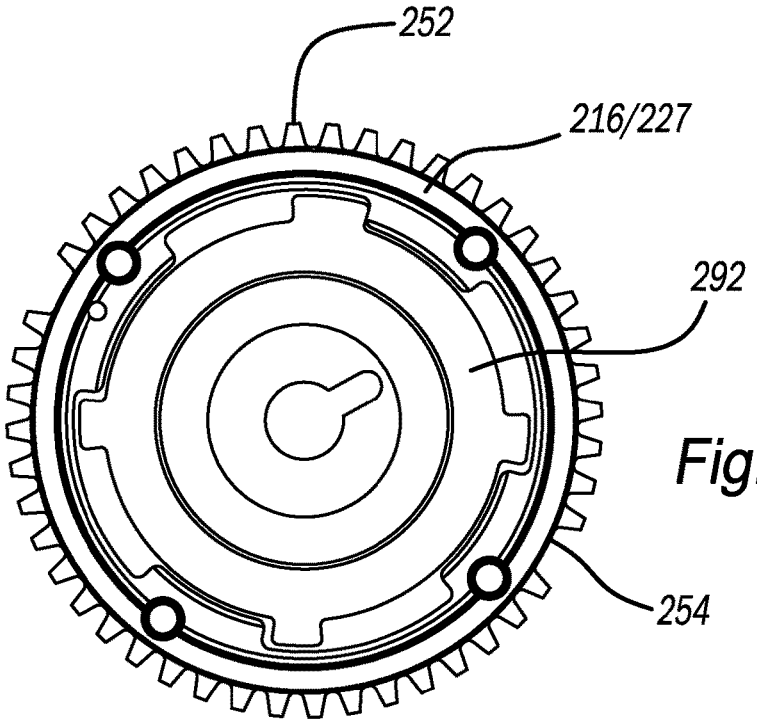
FIG. 22 is an elevational view showing a phaser gear box assembly employed in the third embodiment of the present cylinder head apparatus.
Figure 23:
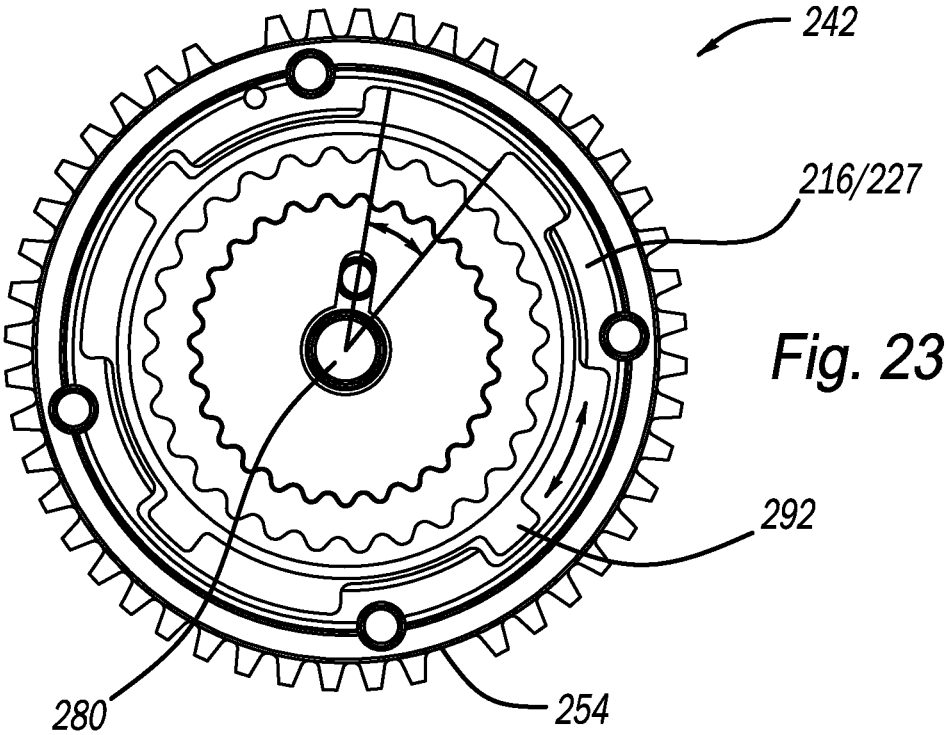
FIG. 23 is an elevational view showing a phaser gear box assembly employed in the third embodiment of the present cylinder head apparatus.

FIGS. 21-23 illustrate internal components of the gear box including an eccentrical input shaft 280, planetary gear 290, camshaft gear 292 and sprocket 216, driven by the electric motor of outer camshaft phaser 208. Two unique approaches are envisioned for mounting the outer camshaft to the rear phaser gear box. The first configuration employs a circular and laterally extending flange 288, which is bolted, welded or otherwise attached to an end of outer camshaft 201. Flange 288 is also bolted or otherwise affixed to phaser gear box 218 (see FIG. 14) for concurrent rotation.

In a second gear box mounting configuration, a housing of gear box 218 is integral as a single part with flange 288 mounted to outer camshaft 201. This flange-to-gear box mounting can alternately be used for any of the electromagnetic phasers disclosed for any of the embodiments herein.

When phaser 208 is energized by the microprocessor controller, the electric motor of phaser rotates faster or slower than the nominal nested camshaft rotation otherwise imparted by the primary crankshaft, which advances (as illustrated by the rotational arrows in FIG. 21) or retards the outer camshaft approximately one to three degrees, and more preferably two degrees, relative to the nominal rotation, for one rotation of the electric motor of the cam phaser. After reaching the desired target valve actuation timing, the phaser motor then rotates at the same speed as the nominal rotational speed imparted by the primary crankshaft.

Figure 24:
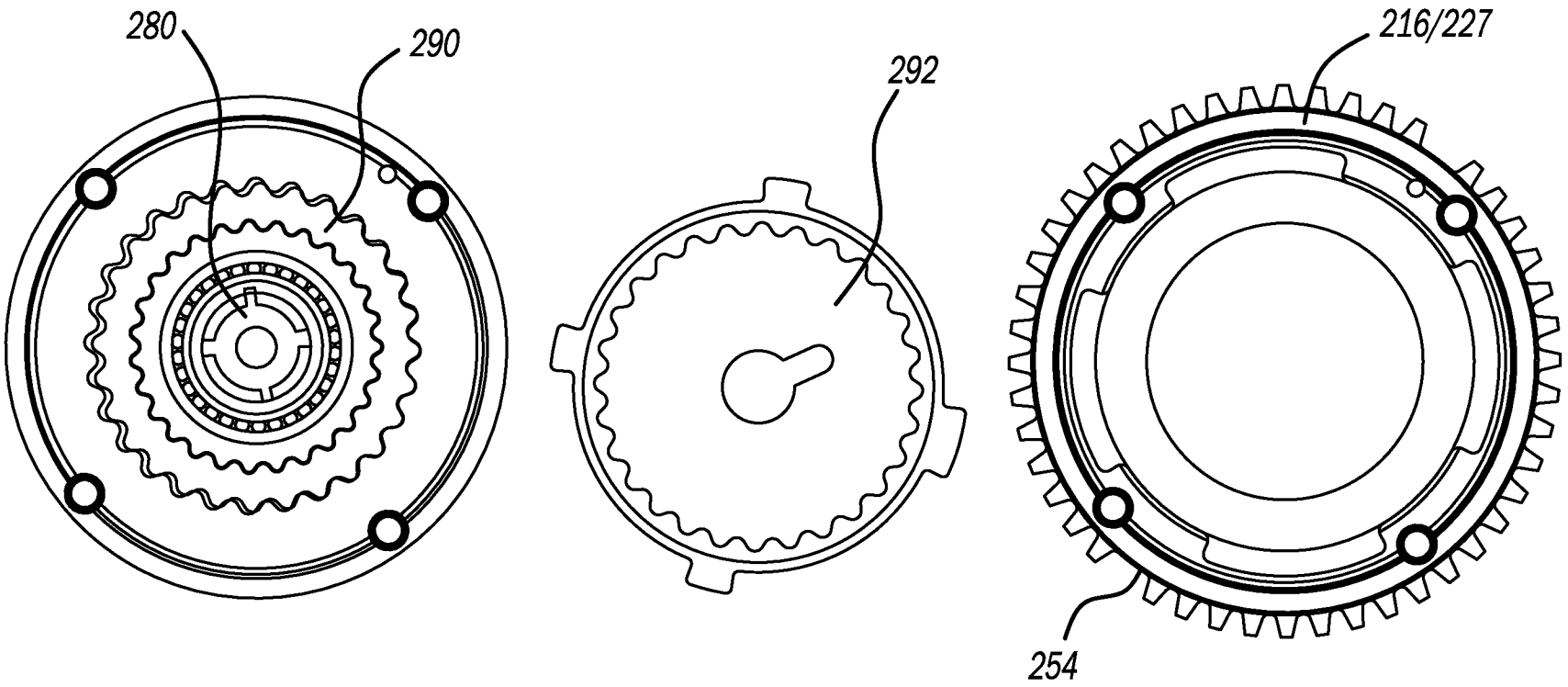
FIG. 24 is an exploded elevational view showing a phaser gear box assembly employed in the third embodiment of the present cylinder head apparatus.

More specifically, FIG. 24 shows the sprocket portion of gear box 218 as part of a non-driven side of the outer camshaft. The 180° circumferentially spaced apart gaps 254 cause the Hall-effect sensor to count a half revolution of the sprocket/timing wheel 216/227 which is associated with one revolution of the primary crankshaft in the present example. The synergistic combination of the timing wheel and sprocket of the present examples beneficially provide multifunctionality of the same component with is incorporated into the outer and/or inner camshafts, and can also be employed with a single (i.e., unnested) camshaft with or without a phaser. This synergistic combination of the timing wheel and sprocket additionally reduces inertia and provides a shorter shaft and gear assembly, thereby reducing its package size.

Figure 25:
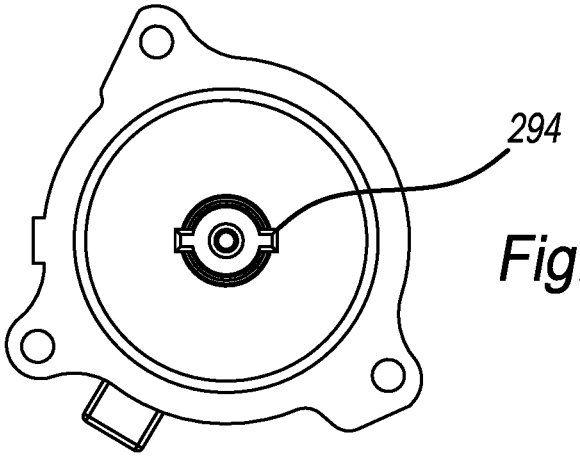
FIGS. 25 and 26 are elevational views showing a phaser electric motor and gear box interface employed in the third embodiment of the present cylinder head apparatus.
Figure 26:
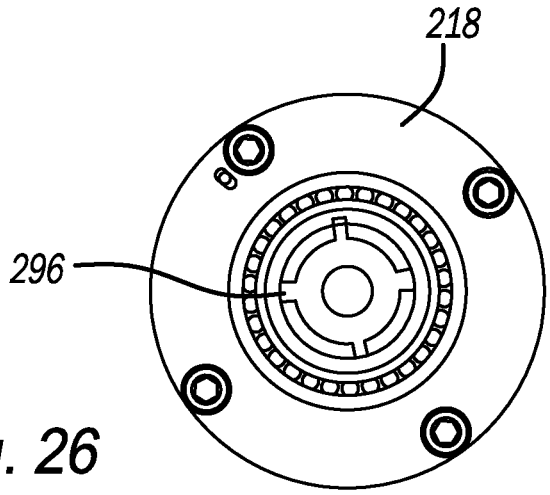

The leftmost illustration in FIG. 24 is cam side up, the central illustration is drive side up and the rightmost illustration is drive side up of the gear box. Furthermore, FIGS. 25 and 26 show key wings 294 transversely projecting from an output shaft rotational axis of electric motor of phaser 208, which engage into matching transversely slotted key holes 296 of gear box 218. An O-ring or the like seals between housings covering the electric motor and gear box. This gear box arrangement and phase/adjustment functionality are also similar for the other phasers.

Figure 27:
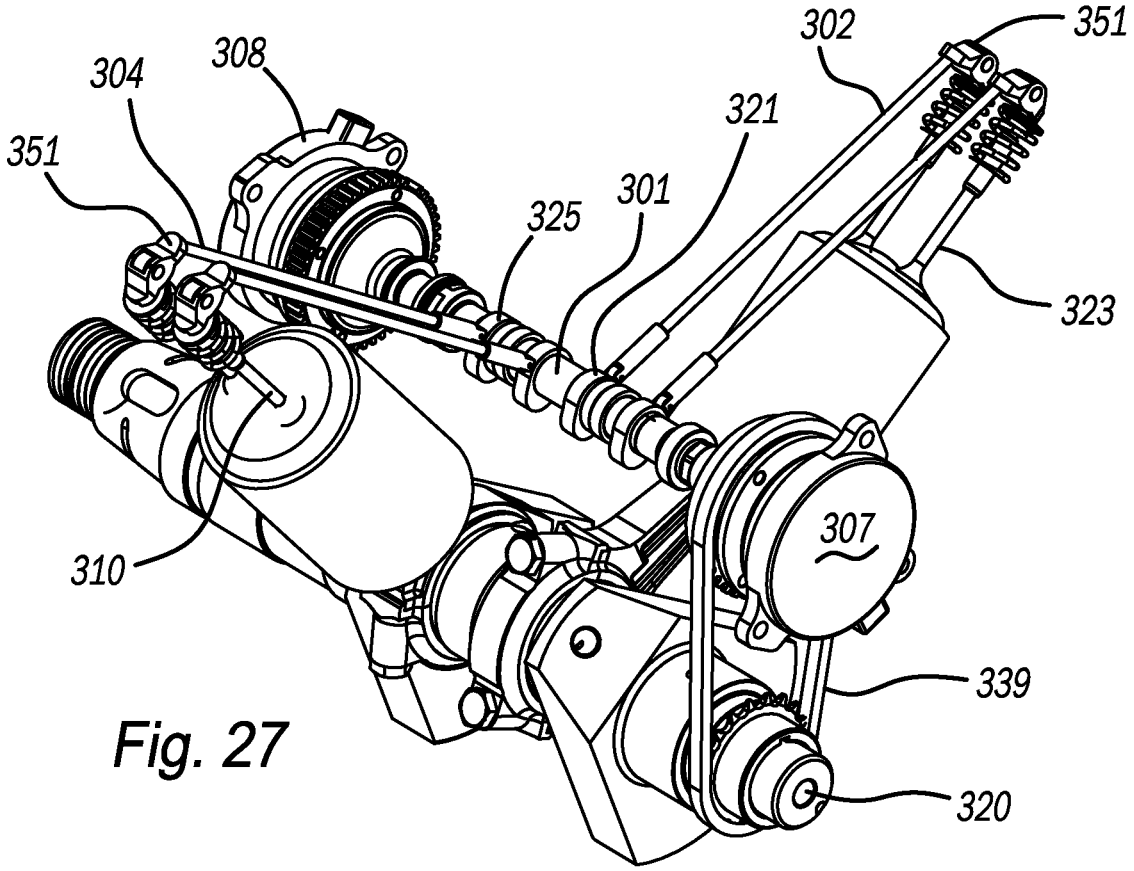
FIG. 27 is a perspective view showing a fourth embodiment of the present cylinder head apparatus.
Figure 28:
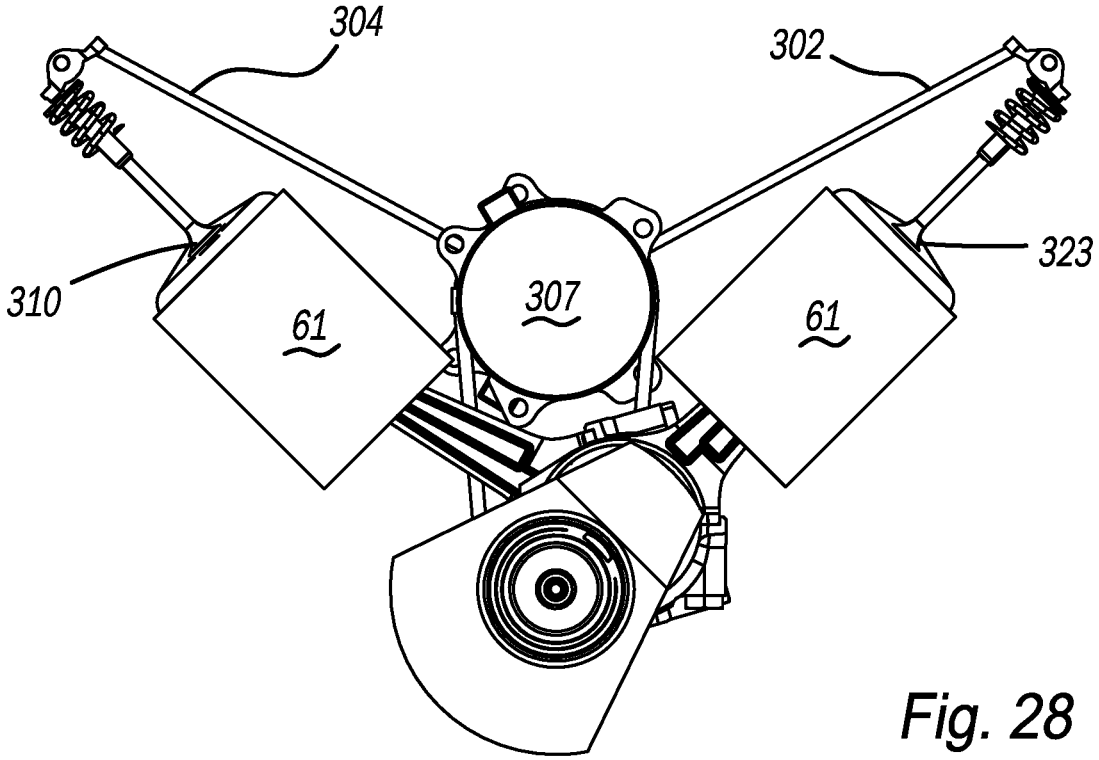
FIG. 28 is an elevational view showing the fourth embodiment of the present cylinder head apparatus.

Finally, another engine apparatus embodiment can be observed in FIGS. 27 and 28. A concentric outer camshaft 301 and inner camshaft (not shown) are rotationally adjusted by outer and inner phasers 308 and 307, respectively. Cam lobes 321 attached to outer camshaft 301 advance and retract push rods 302, while cam lobes 325 attached to the inner camshaft advance and retract push rods 304. The push rods, in turn, rotate rocker arm levers 351, which open primary air intake valves 323 and exhaust valves 310. Phasers 307 and 308 and associated gear boxes rotationally adjust the phase of each of the nested camshafts to be different or the same as the nominal rotation imparted by the closed loop driver 339 and primary crankshaft 320. Thus, the nested camshafts are laterally offset from and between the outboard located valves 310 and 323, such that indirect contact is used for actuation thereof.

While various features of the present invention have been disclosed, it should be appreciated that other variations may be employed. For example, different air valve actuator configurations and positions can be employed, although various advantages of the present system may not be realized. As another example, the cartridge may have a different shape than that illustrated, but certain benefits may not be obtained. Furthermore, the nested camshafts include at least two camshaft and may alternately include two, three or more concentrically nested camshafts and two, three or more associated phasers. It is also envisioned that rocker arms, levers, push rods and/or other force transmissions can be used between the cam lobes and any of the primary and/or prechamber air valves, fuel valves (gasoline, diesel or hydrogen), or mixed air/fuel valves. Additionally, alternate shapes, quantities and angles of the passageways, conduits, openings, ports and apertures may be provided in the cartridge or cylinder head, although some advantages may not be achieved. Variations are not to be regarded as a departure from the present disclosure, and all such modifications are intended to be included within the scope and spirit of the present invention.

The invention claimed is:

1. An internal combustion engine comprising:

a first camshaft;

a second camshaft comprising a hollow end concentrically surrounding a section of the first camshaft;

a phaser coupled to a phased one of the camshafts;

a primary piston combustion chamber;

an internal combustion prechamber comprising a prechamber cavity therein with at least one opening configured to allow prechamber combustion to move from the prechamber cavity to the primary piston combustion chamber;

a prechamber valve assembly comprising at least one of: a prechamber air valve, a prechamber fuel valve or a prechamber mixed air/fuel valve, the prechamber valve assembly having an outlet thereof located in the internal combustion prechamber;

a main valve assembly comprising at least one of: a main valve assembly air valve, a main valve assembly fuel valve or a main valve assembly mixed air/fuel valve, the main valve assembly having an outlet thereof located in the primary piston combustion chamber;

the phaser being configured to move the phased one of the camshafts differently than another of the camshafts;

the phased one of the camshafts actuated by the phaser operably actuating the prechamber valve assembly;

the another of the camshafts operably actuating the main valve assembly;

a third camshaft laterally offset from the first camshaft and the second camshaft;

an air exhaust valve associated with the primary piston combustion chamber being opened or closed by rotation of the third camshaft, one of the first camshaft and the second camshaft opening or closing the main valve assembly air valve which is an air inlet valve associated with the primary piston combustion chamber; and the prechamber valve assembly being laterally located between the first camshaft and the third camshaft.

2. The internal combustion engine of claim 1, wherein the prechamber valve assembly is the prechamber air valve.

3. The internal combustion engine of claim 1, further comprising a second phaser coupled to the third camshaft.

4. The internal combustion engine of claim 1, wherein the prechamber valve assembly is the prechamber air valve which is configured to emit fresh air into the internal combustion prechamber, and the prechamber fuel valve is spaced apart from the prechamber air valve with a fuel outlet of the prechamber fuel valve located in the prechamber cavity, and a rotational axis of the first camshaft and the second camshaft being laterally offset from a longitudinal centerline of the prechamber valve assembly.

5. The internal combustion engine of claim 1, further comprising an elongated push rod, moved by a cam lobe operably rotating with one of the camshafts, operably changing a position of one of the valve assemblies.

6. The internal combustion engine of claim 1, wherein:

the internal combustion prechamber is a turbulent jet ignition prechamber which uses radially directed reacting jets to ignite a high-exhaust gas recirculation primary mixture therein; and the internal combustion prechamber is a preassembled and self-contained cartridge including an ignitor, a fuel injector, the prechamber valve assembly and the prechamber cavity.

7. The internal combustion engine of claim 1, further comprising a sensor and a timing wheel, the timing wheel being coupled to an output of a phaser gear box and associated one of the camshafts, and a laterally extending flange affixed to the one of the camshafts being to coupled to the output of the phaser gear box.

8. The internal combustion engine of claim 1, further comprising:

an intake valve timing wheel coupled to the one of the camshafts;

a purge valve timing wheel coupled to the another of the camshafts;

cam lobes spaced between the intake valve timing wheel and the purge valve timing wheel;

an intake sensor operably sensing a position of the intake valve timing wheel; and a purge sensor operably sensing a position of the purge valve timing wheel.

9. The internal combustion engine of claim 1, further comprising a gear box which comprises:

a sprocket fixedly mounted to the phased one of the camshafts;

a sprocket gear coupled to the sprocket;

an eccentric shaft coupled to the sprocket;

a planetary gear coupled to the sprocket;

a camshaft gear coupled to the sprocket;

a position or rotation detecting sensor associated with the sprocket, the sprocket being a timing wheel;

a closed loop driver, comprising a belt or a chain, operably coupled to the sprocket;

the gear box is driven by the phaser which, in turn, is configured to momentarily rotate faster or slower than the camshafts driven by the closed loop driver; and the prechamber cavity being laterally offset from a rotation axis of the camshafts and the phaser.

10. An internal combustion engine comprising:

a first camshaft;

a second camshaft comprising a hollow end concentrically surrounding a section of the first camshaft;

a phaser coupled to a phased one of the camshafts;

a primary piston combustion chamber;

an internal combustion prechamber comprising a prechamber cavity therein with at least one opening configured to allow prechamber combustion to move from the prechamber cavity to the primary piston combustion chamber;

a prechamber valve assembly comprising at least one of: a prechamber air valve, a prechamber fuel valve or a prechamber mixed air/fuel valve, the prechamber valve assembly having an outlet thereof located in the internal combustion prechamber;

a main valve assembly comprising at least one of: a main valve assembly air valve, a main valve assembly fuel valve or a main valve assembly mixed air/fuel valve, the main valve assembly having an outlet thereof located in the primary piston combustion chamber;

the phaser being configured to move the phased one of the camshafts differently than another of the camshafts;

the phased one of the camshafts actuated by the phaser operably actuating the prechamber valve assembly;

the another of the camshafts operably actuating the main valve assembly;

a rocker arm having a first end contacting against the prechamber valve assembly and having a surface moved by periodic contact with a lobe which rotates with the one of the camshafts; and a rotational axis of the first camshaft and the second camshaft being laterally offset from a longitudinal centerline of the prechamber valve assembly.

11. The internal combustion engine of claim 10, further comprising a sensor and a timing wheel, the timing wheel being coupled to an output of a phaser gear box and associated one of the camshafts, and a laterally extending flange affixed to the one of the camshafts being coupled to the output of the phaser gear box.

12. The internal combustion engine of claim 10, further comprising:

an intake valve timing wheel coupled to the one of the camshafts;

a purge valve timing wheel coupled to the another of the camshafts;

cam lobes spaced between the intake valve timing wheel and the purge valve timing wheel;

an intake sensor operably sensing a position of the intake valve timing wheel; and a purge sensor operably sensing a position of the purge valve timing wheel.

13. The internal combustion engine of claim 10, further comprising a gear box which comprises:

a sprocket fixedly mounted to the phased one of the camshafts;

a sprocket gear coupled to the sprocket;

an eccentric shaft coupled to the sprocket;

a planetary gear coupled to the sprocket;

a camshaft gear coupled to the sprocket;

a position or rotation detecting sensor associated with the sprocket, the sprocket being a timing wheel;

a closed loop driver, comprising a belt or a chain, operably coupled to the sprocket; and the gear box is driven by the phaser which, in turn, is configured to momentarily rotate faster or slower than the camshafts driven by the closed loop driver.

14. An internal combustion engine comprising:

a first camshaft;

a second camshaft comprising a hollow end concentrically surrounding a section of the first camshaft;

a phaser coupled to a phased one of the camshafts;

a primary piston combustion chamber;

an internal combustion prechamber comprising a prechamber cavity therein with at least one opening configured to allow prechamber combustion to move from the prechamber cavity to the primary piston combustion chamber;

a prechamber valve assembly comprising at least one of: a prechamber air valve, a prechamber fuel valve or a prechamber mixed air/fuel valve, the prechamber valve assembly having an outlet thereof located in the internal combustion prechamber;

a main valve assembly comprising at least one of: a main valve assembly air valve, a main valve assembly fuel valve or a main valve assembly mixed air/fuel valve, the main valve assembly having an outlet thereof located in the primary piston combustion chamber;

the phaser being configured to move the phased one of the camshafts differently than another of the camshafts;

the phased one of the camshafts actuated by the phaser operably actuating the prechamber valve assembly;

the another of the camshafts operably actuating the main valve assembly; and an elongated rod having a first end causing opening or closing of the prechamber valve assembly and having a surface moved by periodic contact with a lobe which rotates with the one of the camshafts.

15. The internal combustion engine of claim 14, further comprising a sensor and a timing wheel, the timing wheel being coupled to an output of a phaser gear box and associated one of the camshafts, and a laterally extending flange affixed to the one of the camshafts being coupled to the output of the phaser gear box.

16. The internal combustion engine of claim 14, further comprising:

an intake valve timing wheel coupled to the one of the camshafts;

a purge valve timing wheel coupled to the another of the camshafts;

cam lobes spaced between the intake valve timing wheel and the purge valve timing wheel;

an intake sensor operably sensing a position of the intake valve timing wheel; and a purge sensor operably sensing a position of the purge valve timing wheel.

17. The internal combustion engine of claim 14, further comprising a gear box which comprises:

a sprocket fixedly mounted to the phased one of the camshafts;

a sprocket gear coupled to the sprocket;

an eccentric shaft coupled to the sprocket;

a planetary gear coupled to the sprocket;

a camshaft gear coupled to the sprocket;

a position or rotation detecting sensor associated with the sprocket, the sprocket being a timing wheel;

a closed loop driver, comprising a belt or a chain, operably coupled to the sprocket; and the gear box is driven by the phaser which, in turn, is configured to momentarily rotate faster or slower than the camshafts driven by the closed loop driver.

18. An internal combustion engine comprising:

a first camshaft;

a second camshaft comprising a hollow end concentrically surrounding a section of the first camshaft;

a phaser coupled to a phased one of the camshafts;

a primary piston combustion chamber;

an internal combustion prechamber comprising a prechamber cavity therein with at least one opening configured to allow prechamber combustion to move from the prechamber cavity to the primary piston combustion chamber;

a prechamber valve assembly comprising at least one of: a prechamber air valve, a prechamber fuel valve or a prechamber mixed air/fuel valve, the prechamber valve assembly having an outlet thereof located in the internal combustion prechamber;

a main valve assembly comprising at least one of: a main valve assembly air valve, a main valve assembly fuel valve or a main valve assembly mixed air/fuel valve, the main valve assembly having an outlet thereof located in the primary piston combustion chamber;

the phaser being configured to move the phased one of the camshafts differently than another of the camshafts;

the phased one of the camshafts actuated by the phaser operably actuating the prechamber valve assembly;

the another of the camshafts operably actuating the main valve assembly;

a first valve timing wheel coupled to the one of the camshafts;

a second valve timing wheel coupled to the another of the camshafts;

cam lobes spaced between the first valve timing wheel and the second valve timing wheel;

position or rotation sensors operably sensing a position or rotation of the timing wheels; and the prechamber valve assembly being laterally offset from and longitudinally between the first timing wheel and the second timing wheel and the sensors.

19. The internal combustion engine of claim 18, further comprising a third camshaft laterally offset from the first camshaft and the second camshaft, an air exhaust valve associated with the primary piston combustion chamber being opened or closed by rotation of the third camshaft, one of the first camshaft and the second camshaft opening or closing the main valve assembly air valve which is an air inlet valve associated with the primary piston combustion chamber, and the prechamber valve assembly being laterally located between the first camshaft and the third camshaft.

20. An internal combustion engine comprising:

a first camshaft;

a second camshaft comprising a hollow end concentrically surrounding a section of the first camshaft;

a phaser coupled to a phased one of the camshafts;

a primary piston combustion chamber;

an internal combustion prechamber comprising a prechamber cavity therein with at least one opening configured to allow prechamber combustion to move from the prechamber cavity to the primary piston combustion chamber;

a prechamber valve assembly comprising at least one of: a prechamber air valve, a prechamber fuel valve or a prechamber mixed air/fuel valve, the prechamber valve assembly having an outlet thereof located in the internal combustion prechamber;

a main valve assembly comprising at least one of: a main valve assembly air valve, a main valve assembly fuel valve or a main valve assembly mixed air/fuel valve, the main valve assembly having an outlet thereof located in the primary piston combustion chamber;

the phaser being configured to move the phased one of the camshafts differently than another of the camshafts;

the phased one of the camshafts actuated by the phaser operably actuating the prechamber valve assembly;

the another of the camshafts operably actuating the main valve assembly;

wherein the prechamber valve assembly is a dual-nozzle air-fuel injector comprising both of the prechamber air valve and the prechamber fuel valve therein configured to emit mixed fresh air and fuel into the prechamber cavity; and a rotational axis of the first camshaft and the second camshaft being laterally offset from a longitudinal centerline of the prechamber valve assembly.

21. The internal combustion engine of claim 20, further comprising a sensor and a timing wheel, the timing wheel being coupled to an output of a phaser gear box and associated one of the camshafts, and a laterally extending flange affixed to the one of the camshafts being coupled to the output of the phaser gear box.

22. The internal combustion engine of claim 20, further comprising:

an intake valve timing wheel coupled to the one of the camshafts;

a purge valve timing wheel coupled to the another of the camshafts;

cam lobes spaced between the intake valve timing wheel and the purge valve timing wheel;

an intake sensor operably sensing a position of the intake valve timing wheel; and a purge sensor operably sensing a position of the purge valve timing wheel.

23. The internal combustion engine of claim 20, further comprising a gear box which comprises:

a sprocket fixedly mounted to the phased one of the camshafts;

a sprocket gear coupled to the sprocket;

an eccentric shaft coupled to the sprocket;

a planetary gear coupled to the sprocket;

a camshaft gear coupled to the sprocket;

a position or rotation detecting sensor associated with the sprocket, the sprocket being a timing wheel;

a closed loop driver, comprising a belt or a chain, operably coupled to the sprocket; and the gear box is driven by the phaser which, in turn, is configured to momentarily rotate faster or slower than the camshafts driven by the closed loop driver.

24. An internal combustion engine comprising:

a first camshaft;

a second camshaft comprising a hollow end concentrically surrounding a section of the first camshaft;

a phaser coupled to one of the camshafts;

a primary piston combustion chamber;

an internal combustion prechamber comprising a prechamber cavity therein with at least one opening configured to allow prechamber combustion to move from the prechamber cavity to the primary piston combustion chamber;

a prechamber valve assembly comprising at least one of: a prechamber air valve, a prechamber fuel valve or a prechamber mixed air/fuel valve, the prechamber valve assembly having an outlet thereof located in the internal combustion prechamber;

a main valve assembly comprising at least one of: a main valve assembly air valve, a main valve assembly fuel valve or a main valve assembly mixed air/fuel valve, the main valve assembly having an outlet thereof located in the primary piston combustion chamber;

a rotational axis of the first camshaft and the second camshaft being laterally offset from a longitudinal centerline of the prechamber valve assembly;

the phaser being configured to move the phased one of the camshafts differently than another of the camshafts;

the phased one of the camshafts actuated by the phaser operably actuating the prechamber valve assembly; and the another of the camshafts operably actuating the main valve assembly;

wherein the prechamber valve assembly is the prechamber air valve which is configured to emit fresh air into the internal combustion prechamber, and the prechamber fuel valve is spaced apart from the prechamber air valve with a fuel outlet of the prechamber fuel valve located in the prechamber cavity.

25. The internal combustion engine of claim 24, wherein the prechamber valve assembly is the prechamber air valve.

26. The internal combustion engine of claim 24, further comprising:

a rocker arm having a first end contacting against the prechamber valve assembly and having a surface moved by periodic contact with a lobe which rotates with the one of the camshafts;

the internal combustion prechamber being a dual mode, turbulent jet ignition prechamber which uses radially directed reacting jets to ignite a high-exhaust gas recirculation primary mixture therein; and the internal combustion pre-chamber being a preassembled and self-contained cartridge including an ignitor, a fuel injector, the prechamber valve assembly and the prechamber cavity.

27. The internal combustion engine of claim 24, further comprising:

an elongated rod having a first end causing opening or closing of the prechamber valve assembly and having a surface moved by periodic contact with a lobe which rotates with the one of the camshafts;

the prechamber being a dual mode, turbulent jet ignition prechamber which uses radially directed reacting jets to ignite a high-exhaust gas recirculation primary mixture therein; and the pre-chamber being a preassembled and self-contained cartridge including an ignitor, a fuel injector, the prechamber valve assembly and the prechamber cavity.

28. The internal combustion engine of claim 24, further comprising:

a first valve timing wheel coupled to the one of the camshafts;

a second valve timing wheel coupled to the another of the camshafts;

cam lobes spaced between the first valve timing wheel and the second valve timing wheel;

position or rotation sensors operably sensing a position or rotation of the timing wheels; and the prechamber valve assembly being laterally offset from and longitudinally between the first timing wheel and the second timing wheel and the sensors.

29. The internal combustion engine of claim 24, further comprising a third camshaft laterally offset from the first camshaft and the second camshaft, an air exhaust valve associated with the primary piston combustion chamber being opened or closed by rotation of the third camshaft, one of the first camshaft and the second camshaft opening or closing the main valve assembly air valve which is an air inlet valve associated with the primary piston combustion chamber, and the prechamber valve assembly being laterally located between the first camshaft and the third camshaft.

30. The internal combustion engine of claim 29, further comprising a second phaser coupled to the third camshaft.

31. The internal combustion engine of claim 24, wherein the prechamber valve assembly is a dual-nozzle air-fuel injector comprising both of the prechamber air valve and the prechamber fuel valve therein configured to emit mixed fresh air and fuel into the prechamber cavity.

32. The internal combustion engine of claim 24, further comprising an elongated push rod, moved by a cam lobe operably rotating with one of the camshafts, operably changing a position of one of the valve assemblies.

33. The internal combustion engine of claim 24, further comprising a second phaser, the phasers being at opposite ends of the camshafts, wherein the camshafts are nested.

34. The internal combustion engine of claim 24, further comprising a sensor and a timing wheel, the timing wheel being coupled to an output of a phaser gear box and associated one of the camshafts, and a laterally extending flange affixed to the one of the camshafts being coupled to the output of the phaser gear box.

35. The internal combustion engine of claim 24, further comprising:

an intake valve timing wheel coupled to the one of the camshafts;

a purge valve timing wheel coupled to the another of the camshafts;

cam lobes spaced between the intake valve timing wheel and the purge valve timing wheel;

an intake sensor operably sensing a position of the intake valve timing wheel; and a purge sensor operably sensing a position of the purge valve timing wheel.

* * * * *